US006493453B1

(12) United States Patent
Glendon

(10) Patent No.: US 6,493,453 B1
(45) Date of Patent: Dec. 10, 2002

(54) HEARING AID APPARATUS

(75) Inventor: Douglas H. Glendon, 15 Chestnut St., North Reading, MA (US) 01864

(73) Assignee: Douglas H. Glendon, North Reading, MA (US)

( * ) Notice: Subject to any disclaimer, the term of this patent is extended or adjusted under 35 U.S.C. 154(b) by 0 days.

(21) Appl. No.: 09/258,014

(22) Filed: Feb. 25, 1999

Related U.S. Application Data

(63) Continuation-in-part of application No. 09/115,779, filed on Jul. 14, 1998, now abandoned, which is a continuation of application No. 08/676,573, filed on Jul. 8, 1996, now Pat. No. 5,812,680.

(51) Int. Cl.[7] ..... H04R 25/00

(52) U.S. Cl. ..... 381/322; 381/323; 381/324; 381/328

(58) Field of Search ..... 381/23.1, 322, 381/324, 325, 328, 329, 380; 63/12; 181/130, 135

(56) References Cited

U.S. PATENT DOCUMENTS 2,477,046 A * 7/1949 Davenport ..... 381/328
2,549,629 A * 4/1951 Nelson ..... 381/328
2,964,596 A * 12/1960 Christensen ..... 381/328
3,068,954 A * 12/1962 Strzalkowski ..... 381/328
3,209,082 A * 9/1965 McCarrell et al. ..... 381/328
RE26,174 E * 3/1967 Leale ..... 381/328
3,983,336 A * 9/1976 Malek et al. ..... 381/328
4,539,440 A * 9/1985 Sciarra ..... 381/328
4,870,688 A * 9/1989 Voroba et al. ..... 381/328
4,975,967 A * 12/1990 Rasmussen ..... 381/328
5,031,219 A * 7/1991 Ward et al. ..... 381/328
5,345,509 A * 9/1994 Hofer et al. ..... 381/328
5,365,593 A * 11/1994 Greenwood et al. ..... 381/328
5,812,680 A * 9/1998 Glendon ..... 381/322
5,828,757 A * 10/1998 Michalson et al. ..... 381/328

* cited by examiner

*Primary Examiner*—Sinh Tran
*Assistant Examiner*—Suhan Ni
(74) *Attorney, Agent, or Firm*—Cesari and McKenna, LLP

(57) ABSTRACT

An improved earring-style hearing aid that includes an ear mold that renders the majority of the ear canal unfilled, and that delivers to the eardrum amplified sound that is received through a breakaway connector from a hearing aid circuit that is attached to the ear lobe and that can be configured using one of many different covers to take the appearance of one of many different earrings.

25 Claims, 23 Drawing Sheets

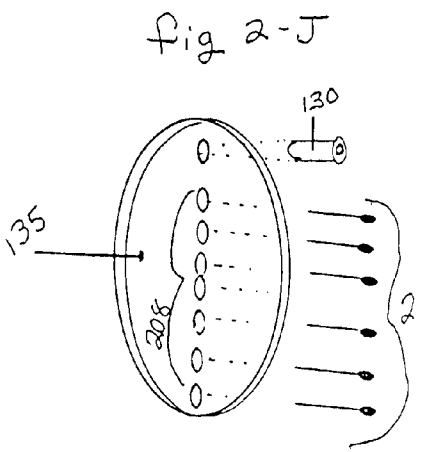
Fig 2-J
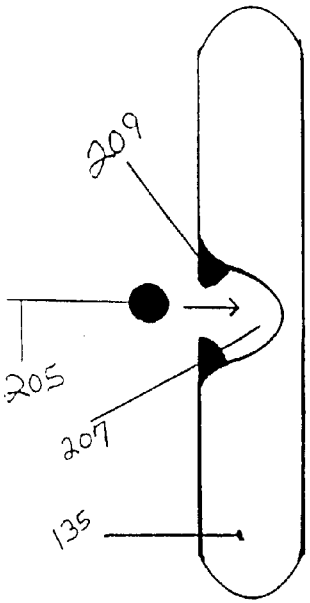
Fig 2i
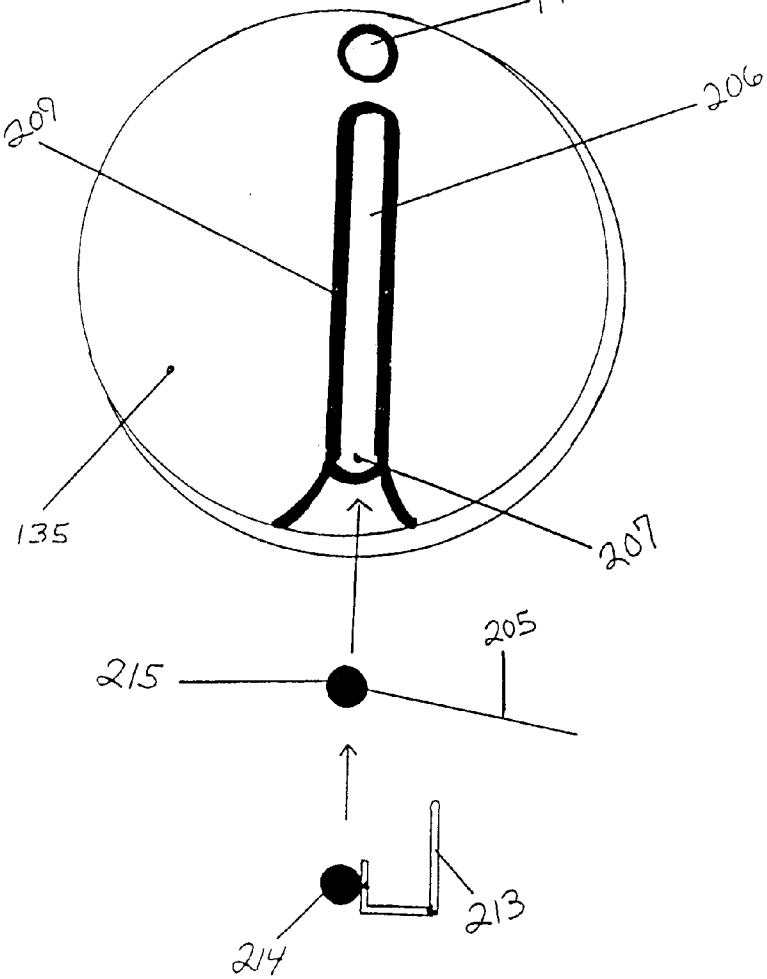
Fig 2H 400
445

432
160

445
432
400

432
400
445

140
445
432
400
160
135

445
160
400
445
160
135

135

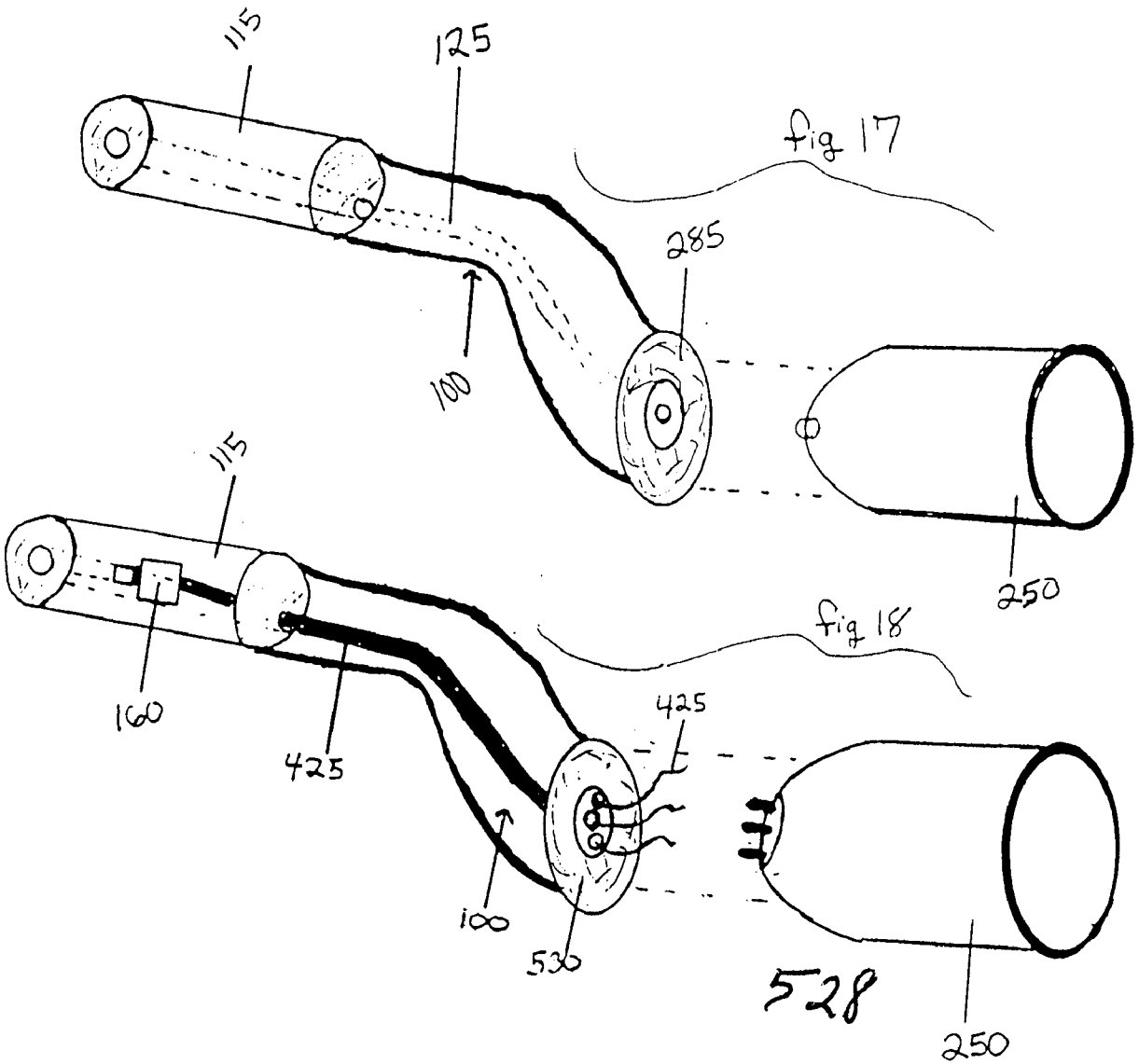
528

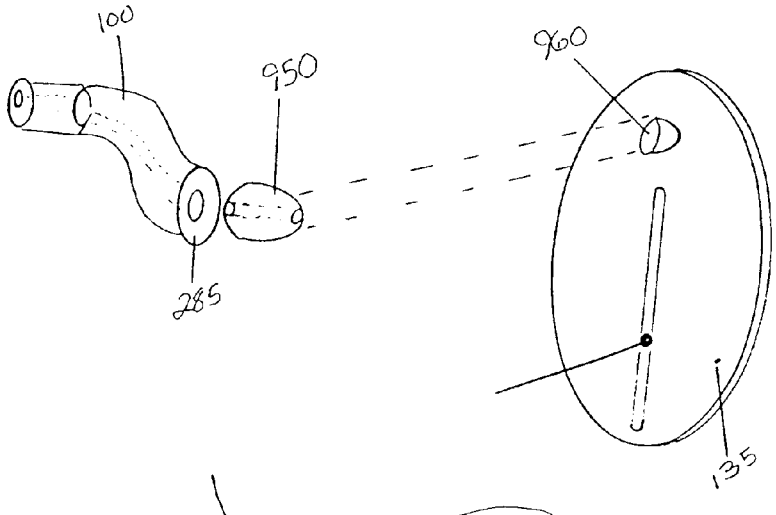
fig 30A
fig 30B
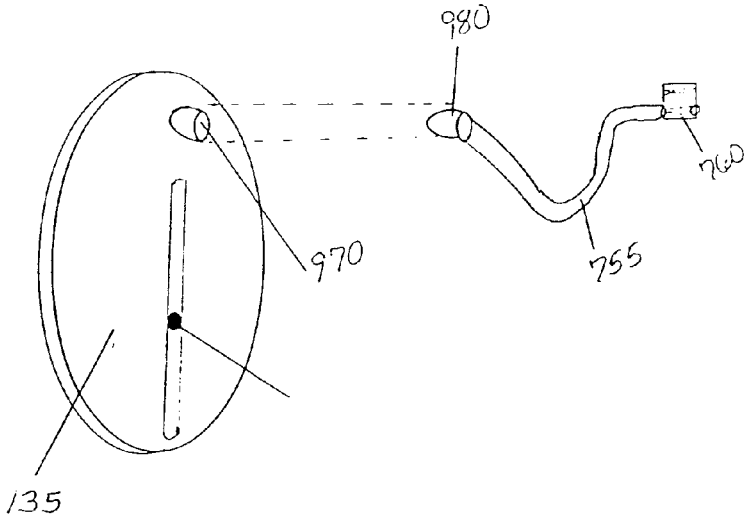

HEARING AID APPARATUS

CROSS REFERENCE TO RELATED APPLICATIONS

This application is a Continuation-in-Part of Ser. No. 09/115,779 file date Jul. 14 1998, abandoned, which is in turn a Continuation of Ser. No. 08/676,573 file date Jul. 8 1996, now U.S. Pat. No. 5,812,680, the disclosure of which is hereby incorporated by reference.

BACKGROUND OF THE INVENTION

The present invention relates to an improved hearing aid apparatus, and more particularly an earring-style hearing aid apparatus.

A hearing aid user typically desires a hearing aid that is not conspicuous when worn. A hearing aid that is conspicuous when worn makes apparent the wearer's need for a hearing aid and is therefore typically perceived as unattractive by a hearing aid user. This perception has led to various attempts to camouflage or disguise hearing aids, or to make hearing aids more attractive by adorning them with decorative elements. The decorative elements are typically disposed directly on the hearing aid, or in the hearing aid wearer's earlobe having the effect of covering the hearing aid or disguising the hearing aid as a piece of jewelry being worn in the wearer's ear or ear lobe. One problem with such decorative elements is that they increase the surface of the hearing aid that exists outside the ear. By doing so, they increase the chances of an impact being delivered to the area of the hearing aid that exists outside the ear. Such an impact can be transmitted to the parts of the hearing aid that reside in the inner ear thereby causing injury to the wearer.

Furthermore, such decorative elements fail to offer a visual appearance that varies from day to day. If the same decorative element is consistently displayed, the aesthetic appeal of the disguised hearing aid is detracted from and the wearer is again stigmatized as always wearing the same piece of jewelry. In a similar vein, each wearer has ear characteristics that are infinitely different from another wearer's ear characteristics. For example, the shape and size of the inner ear, the outer ear and the earlobe vary greatly from person to person. Thus, the disguised hearing aid must provide the flexibility needed so that it can be adapted to any one wearer's specific features while at the same time providing quality aided hearing.

More recently, advancements have been made allowing for the miniaturization of parts. Smaller hearing aids have resulted from such advancements. However, feedback problems can arise when circuit components are placed to closely together. For instance, placing the microphone too close to the amplifier output can result in feedback of the output signal back into the microphone. Such feedback reduces the effectiveness of the hearing aid. Also, over crowding miniaturized components into one housing may result in occlusion of the ear canal, which further reduces the effectiveness of the hearing aid. Also, the severe or profoundly hearing impaired need larger electronic components to deliver the volume or power needed to improve their hearing.

Certain hearing aids that fill a substantial part of the ear canal with solid components or sound conduit also increase the chances of damage to the ear because of an impact delivered to the area of the outer ear. Such damage can occur when the hearing aid is contacted by one of many forces arising in an unlimited number of situations. For example, an accidental nudging from a fellow commuter on a crowded train, or a slip and fall by the wearer, or an article of clothing that becomes ensnared on the hearing aid.

What is needed is an inconspicuous hearing aid that employs a breakaway connection feature. The breakaway connection feature being used to isolate the portion of the hearing aid that resides in the wearer's inner ear from the portion that resides outside the ear. Thus, with such a hearing aid, the force from an impact to the portion of the hearing aid outside the ear would be dissipated across the breakaway connection and never be delivered to the inner portion of the hearing aid thereby protecting the wearer from sustaining inner ear damage.

What more is needed is a sound conduit for delivering a signal generated by a hearing aid circuit to an area proximate the hearing aid wearer's eardrum where the sound conduit does not substantially fill the ear canal. Such a conduit design would offer further protection to the wearer. In addition, such a hearing aid must provide flexibility so as to accommodate the wearer's individual ear features, as well as their fashion interests. Also needed is a hearing aid that considers the spatial location and shielding of components that comprise the hearing aid circuit so as to optimize the circuit performance.

SUMMARY OF THE INVENTION

The invention is based on the discovery that an attractive, effective, safer hearing aid can be obtained if a cosmetically attractive housing outside the ear canal is removably connected to an ear canal sound conduit by a breakaway connector that transmits sound effectively.

The invention features an apparatus for delivering a signal generated by a hearing aid circuit to an area proximate the apparatus wearer's eardrum. The apparatus includes, in part, a moldable ear canal sound conduit that has an overall cross-sectional area that is much smaller than the cross-sectional area of the ear canal. The sound conduit, however, does have a small portion near the wearer's eardrum that tends to fill that area of the ear canal. As such, an electronic component such as a receiver can be deployed in that portion of the conduit. The invention renders the majority of the ear canal unfilled. An outermost portion of the sound conduit is disposed at the intertragic notch of the wearer's ear.

The outermost portion of the sound conduit is coupled to a housing by a breakaway connector that can resemble a nipple. The breakaway connector has the ability to conduct a signal generated by a hearing aid circuit to the sound conduit so that the signal is delivered to the wearer's ear drum. The connection afforded by the breakaway connector is such that when an impact is delivered to the housing, the breakaway connector either pops out of, or collapses against the outermost portion of the sound conduit. The result is that the force of the impact is not delivered to the sound conduit, and the wearer's inner ear is spared from sustaining injury.

A hearing aid circuit is stored in the housing. The components that comprise the circuit are disposed in the housing such that the position of each component reduces or eliminates undesirable feedback within the circuit. As suggested above, some of the hearing aid components can be disposed in the innermost portion of the sound conduit near the eardrum. The invention can include a circuit holder that is designed to hold the circuit components. The circuit holder is coupled to the housing. Again, the position and shielding of the components within the circuit holder are selected to optimize circuit performance. Such selections are also made while considering the overall-size of the housing.

The housing is equipped with an attachment mechanism that is adjustable. This adjustable mechanism allows the wearer to attach the apparatus to the earlobe, whether pierced or not. Furthermore, the exact position and angle at which the housing must be in order to properly conceal the sound conduit that is disposed in the wearer's ear can be easily selected by the wearer. This flexibility results, in part, from an adjustable stud-pin disposed in a vertical slot in the housing. The stud-pin is secured within the housing in such a way that it is easily manipulated to a desired position and angle, but remains put after the adjustment is complete. However, for safety considerations, the stud-pin is not secured so tightly that it has no give when the housing of the apparatus is impacted with a force. On the contrary, the stud-pin will yield and give way if the housing is so impacted. Of course the user will have to re-adjust the desired position and angle of the stud-pin after the impact, but such re-adjustment is trivial in comparison to the damage the wearer could sustain without such give in the stud-pin.

The housing can also be accompanied by a cover that is aesthetically appealing. An earring can be selected so as to mimic the apparatus such that the earring has an interchangeable face plate that is similar in size, shape and appearance to the cover of the housing of the apparatus. This allows the wearer to wear the apparatus in the ear that requires the hearing aid, and the earring in the other ear so as to give the impression that the wearer is simply wearing a pair of earrings. Moreover, the wearer will have the option of choosing from a set of earring face plate/housing cover combinations such that the appearance of the apparatus and its accompanying earring can be changed on a regular basis. The earring face plate/housing cover combinations can vary greatly in design and be oversized in comparison to the housing. Of course the wearer can wear an apparatus in both ears if needed. In such a case, each apparatus can have matching housing covers.

The invention also features a hearing aid apparatus that is comprised of various electrical components that can capture sound external to the wearer's ear, convert that captured sound to an electrical signal, amplify that electrical signal, and then convert that amplified signal into a sound pressure signal that can be received by the eardrum. These components are used in conjunction with the other features of the invention described herein. A receiver that converts the amplified signal into a sound pressure signal can be disposed in the innermost portion of the sound conduit near the eardrum. In such a case, electronic coupling means provides a transmission path between the amplifying part of the circuit and the receiver so that the amplified signal can be received by the receiver. Keeping in step with the safety objectives of the invention, the electronic coupling means preferably employs a breakaway connection at the point where the nipple end of the breakaway connector engages the outermost portion of the sound conduit.

The invention provides several advantages. A hearing aid is provided that is less conspicuous and more attractive when worn because the exposed portion of the hearing aid has the appearance of an attractive earring and hides the inner-ear portion of the hearing aid. The appearance, including the color, of the exposed earring portion of the hearing aid can be easily changed, which makes the hearing aid less conspicuous by providing for aesthetic variety and allowing fashion coordination. Feedback of the amplified output signal back into the microphone is reduced by thoughtful placement and shielding of the components comprising the hearing aid circuit. The risk of injury resulting from an impact on the exposed portion of the hearing aid is reduced. Such reduction of injury comes as a result of the breakaway connection coupling the housing to the moldable ear canal sound conduit, the give-way qualities of the stud-pin, and the fact that the moldable ear canal sound conduit does not substantially fill the ear canal.

The above summary is a general concise statement regarding the invention and is by no way considered a complete disclosure of all the features and benefits of the invention. Other features and advantages of the invention will become apparent from the following description and claims.

BRIEF DESCRIPTION OF THE DRAWINGS

FIGS. 2H, 2I, and 2J are diagrams of alternate embodiements of the stud pin.

FIGS. 15, 16, and 18 are diagrams showing exemplary disassembled views of a receiver placement and an electrode connector placement according to the invention.

FIG. 17 is a diagram of one embodiment of an ear mold showing the break away connection according to the invention.

FIGS. 21–22 are diagrams of one embodiment of a dissembled view of an earlobe fastening system according to the invention.

FIGS. 30A–30B are diagrams of one embodiment of a dissembled view of a reverse breakaway connector system according to the invention.

DESCRIPTION OF THE PREFERRED EMBODIMENTS

Figure 1:
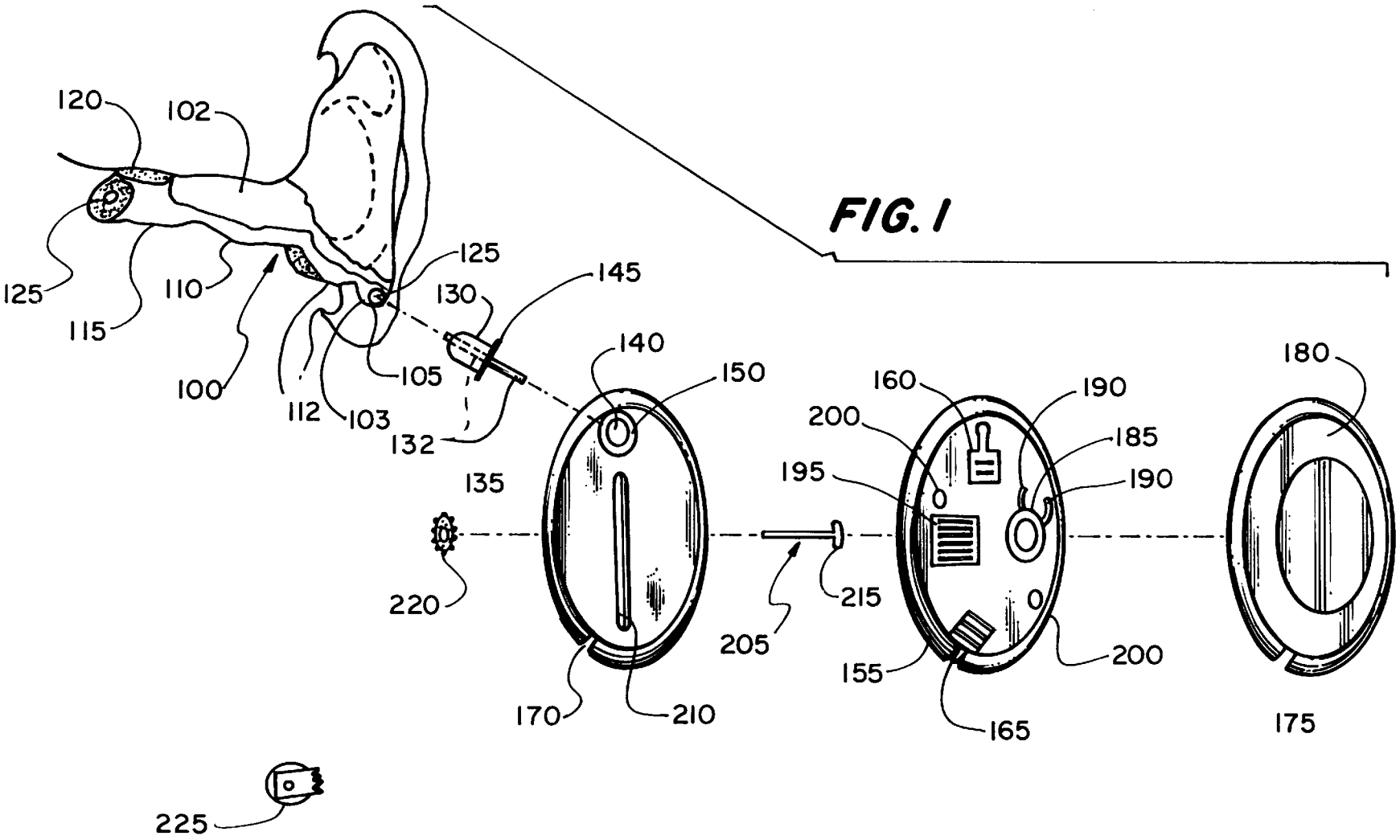
FIG. 1 is a diagram of one embodiment of the invention, and an example of how the invention can engage the wearer's ear.

An attractive, effective, and safer hearing aid can be obtained if a cosmetically attractive amplifier housing outside the ear canal is removably connected to an ear canal sound conduit by a connector that transmits sound effectively. With reference to FIG. 1, in one embodiment of the invention, the sound conduit is a mold 100 that is insertable into the auditory canal 102 of the outer ear. The mold is preferably custom-made, using a flexible material such as LUCITE or VINYL-FLEX preferably having a color that helps to camouflage the mold after insertion. When the mold is inserted, the outermost portion 103 of the mold appears at intertragic notch 105 of the outer ear. The mold has a middle portion 110 that runs along the bottom side of the concha bowl 112 and auditory canal 102 of the ear. In a preferred embodiment, middle portion 110 is a thin tongue-shape. However, those skilled in the art will recognize that the purpose of the thin tongue shape is to leave the majority of the ear canal unfilled. Thus other shapes that serve this purpose will also be appreciated as applied in this invention. For example, oval shaped of sideways-K shaped, or V shaped. Furthermore, the mold can run along the sides of the ear canal as opposed to the bottom.

Near the eardrum, innermost portion 115 of the mold preferably has a substantially cylindrical shape and nearly completely fills a small portion of the canal. The innermost portion 115 of the mold provides a channel vent 120 to allow venting of sound pressure. The innermost portion of the mold is also preferably coated using both hardcoat and softcoat ultraviolet treatments to reduce sound leakage back through the ear canal, which can cause feedback.

In one embodiment in which sound is transmitted through the mold as sound pressure waves, the mold includes a hollow receiver tube 125 that is enclosed within mold 100. Ideally the tube is an industry standard in-the-ear canal hearing-aid tube that is approximately 0.0625 inches in diameter. The tube 125 extends from the intertragic notch 105 to the bony area of the auditory canal at innermost portion 115 of the mold.

In one embodiment of the invention, the majority of the auditory canal 102 of the outer ear is not filled with ear mold material. Rather, mold 100 fills only a small portion of the canal along the bottom of the auditory canal and concha bowl area. Thus, if a cross-sectional area of the ear canal was taken while the mold was inserted, it would be seen that the cross-sectional area of the middle portion of the mold is substantially less than the cross-sectional area of the ear canal. As a result, any sound leakage escaping through the channel vent 120 passes through the largely unfilled auditory canal 102 and disperses into the atmosphere without creating feedback.

A breakaway connector 130, described in more detail below, abuttingly engages an opening at the outermost portion of the mold 100 at the intertragic notch 105. In a preferred embodiment, the breakaway connector has a nipple end and is hollow, and further includes an extension 132 of receiver tube 125. The breakaway connector couples mold 100 with a hearing aid housing 135. In one embodiment, the breakaway connector connects into housing 135 through an aperture 140. The breakaway connector preferably has an annular ring or groove 145 that fits into a corresponding housing groove 150 that is on housing 135 and that is around aperture 140. The complimentary grooves 145, 150 operate to hold the breakaway connector in place once it is inserted into aperture 140. However, the breakaway connector may be coupled to the housing by other means as well. For example, see FIGS. 10 and 14, which will be discussed in turn.

Preferably, the breakaway connector is soft, flexible, and bends easily. A glancing force of impact exerted upon housing 135 causes breakaway connector 130 to give way or break off from the outermost portion of mold 100.(A direct force of impact that pushes housing 135 towards the eardrum causes breakaway connector 130 to squish or collapse) Thus the delicate parts of the ear canal and eardrum are isolated from the impact. Together, the flexible nature of the ear mold and the breakaway nature of the breakaway connector operate to protect the ear from impact damage.

In a preferred embodiment, housing 135 is about 0.875 inches in diameter and about 0.2 inches in thickness, and houses a removable circuit holder 155. The circuit holder preferably snaps firmly and removably into the housing using pre-formed grooves. The circuit holder houses microelectronic components. Preferably, pre-formed indentations are used in the circuit holder to hold all of the electronic components. In this preferred embodiment, some of the electronic components are placed such that circuit holder 155 fits into housing 135 in only one way. Thus, for example, the proper placement of an electronic receiver component 160 and a microphone component 165 into the circuit holder can be important. Unless both of these components are placed properly in circuit holder 155, housing 135 and circuit holder 155 will not fit together properly. The microphone 165 preferably aligns with an opening 170 of housing 135. A cover 180, described in more detail below, has a corresponding opening 175, which also preferably aligns with microphone 165. Similarly, the electronic receiver component 160 preferably aligns with aperture 140. Preferably both electronic receiver 160 and microphone 165 include rubber-like gaskets to contain internal feedback. Those skilled in the art will recognize other methods of shielding components to reduce feedback.

Other components can be placed in circuit holder 155 while consideration must be given to the limited space available. These components may include a battery 185, battery terminals 190, an amplifier 195 and potentiometers 200. Those skilled in the art will recognize other hearing aid circuitry may be desirable. For example, the following may also be included: a manual volume control, an automatic gain control circuit, an adjustable peak clipping circuit, a tone control, a programmable volume control, and a set screw volume control.

In another embodiment, the circuit holder 155 holds an interface module for connecting into a digitally programmable hearing instrument system. FIG. 7A shows a female interface module 197 which fits into the circuit holder 155. The female module can fit into a circumscribed area of the circuit holder 155. The female interface module 197 is wired into the hearing aid circuitry in the circuit holder 155 as is known in the art. The male module 198 is removably insertable into the female module. The male module is connected to a computer programming device, known in the art that can instruct the hearing aid circuitry in circuit holder how to process the signal electronically.

Figure 7:
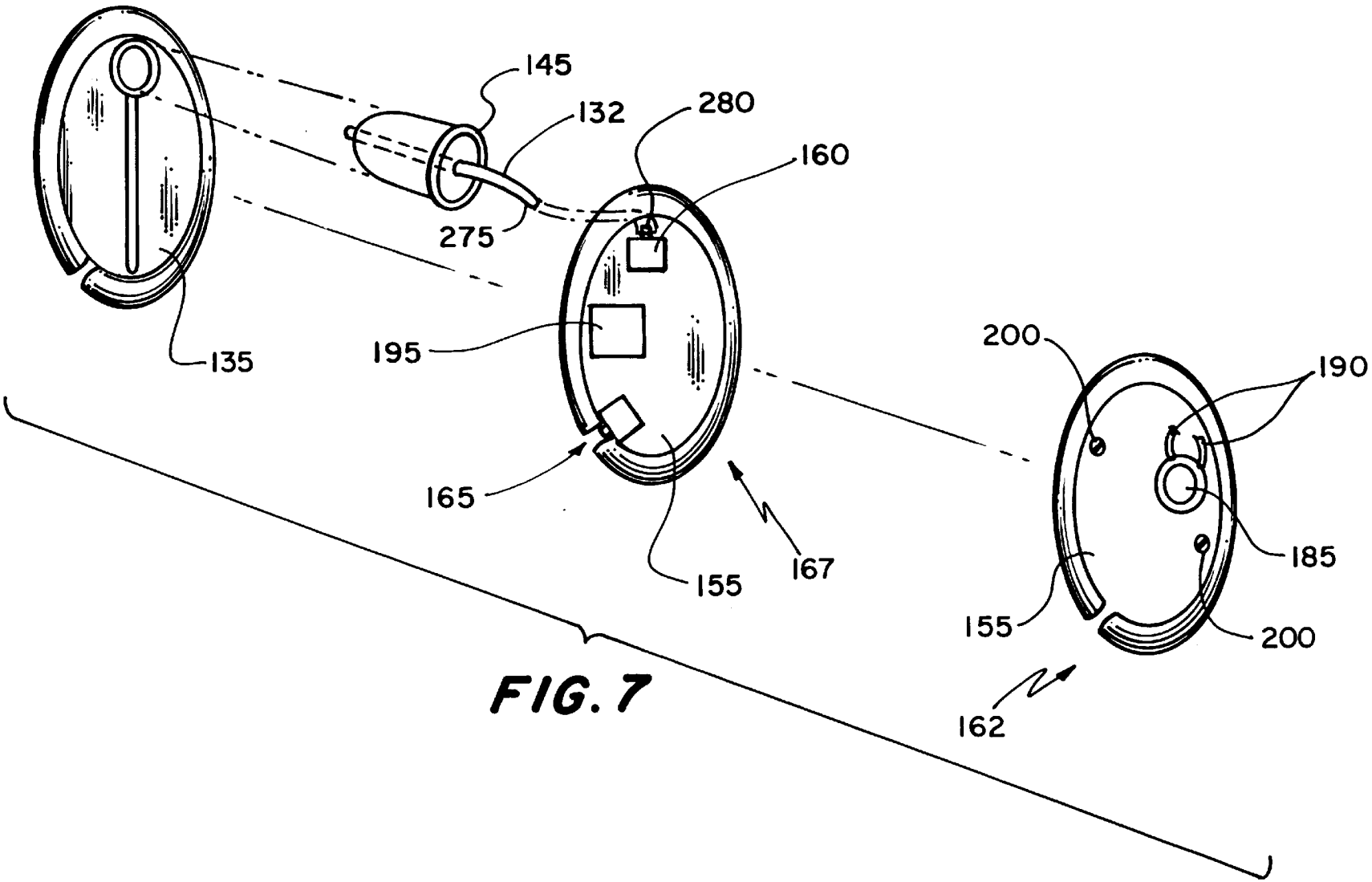
FIG. 7 is a detailed diagram of one embodiment of a disassembled hearing aid according to the invention.
Figure 7A:
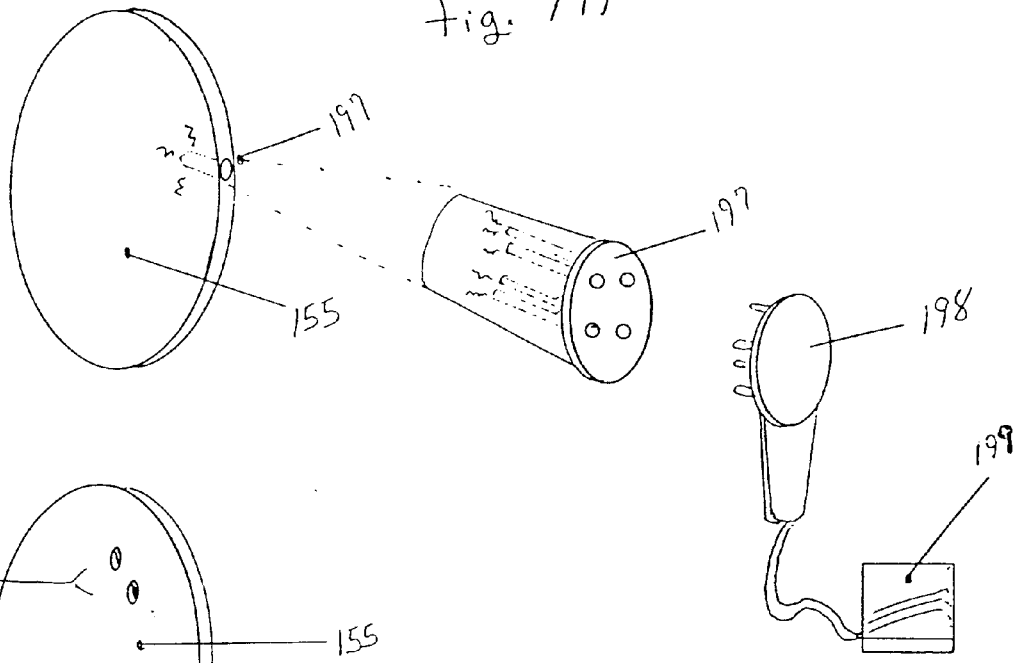
FIGS. 7A and 7B are diagrams of one embodiement of the invention illustrating the adaptor used to interface the hearing aid with a digitally programmable hearing instrument control system.
Figure 7B:
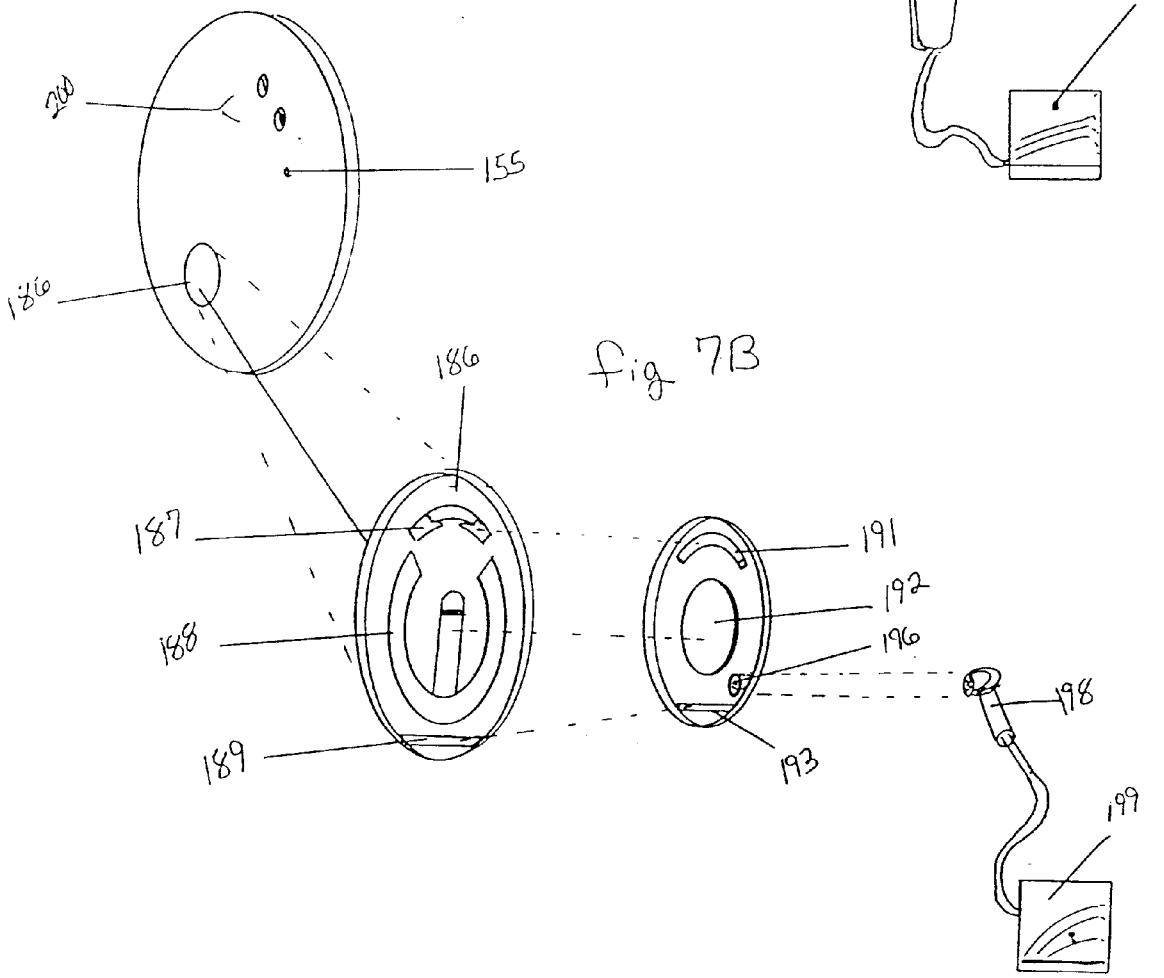

FIG. 7B shows the circuit holder 155 can be programmed through a battery door connection. The circuit holder 155 contains a battery holder 186. This battery holder can be configured in a shape known in the art as a "toilet bowl door battery system" or a flat system. Other configurations are known to those skilled in the art. The battery holder 186 includes 3 terminals 187–189. The terminals 187–189 connect through a special adapter 196 that holds terminals 191–193. When the terminals 187–189 are nested with adapter terminals 191–193, they form an electrical connection. Terminals 191–193 are operatively connected to the female module adapter 196. The female adapter 196 can then accept the male module 198 and as previously described connect to the digitally programmable computer.

In another embodiment, circuit holder 155 preferably holds battery 185 in a pre-formed indentation. When placed into the indentation, the battery is intended to fit only with its positive side exposed. When the battery is placed properly into the indentation, cover 180 holds the battery in place. If the battery is placed upside-down in the indentation, cover 180 does not fit properly onto housing 135. Furthermore, when circuit holder 155 is open for view with cover 180 removed, preferably only battery 185 and the potentiometers 200 are exposed. Preferably all of the other electronic components are placed unexposed under the bottom side of circuit holder 155.

In another embodiment, breakaway connector 130 is placed into aperture 140 on housing 135. As mentioned above, breakaway connector 130 encloses extension 132 of receiver tube 125. The circuit holder 155 snaps into housing 135 and holds breakaway connector 130 in place. An output from receiver component 160 is coupled to extension 132 that is enclosed in breakaway connector 130. The output of receiver component 160 consists of sound pressure waves, and travels through breakaway connector 130 by way of extension 132. A nipple end of breakaway connector 130 is coupled to receiver tube 125. Thus, after traveling through breakaway connector 130, the output of receiver component 160 is able to enter receiver tube 125 of ear mold 100. With mold 100 and housing 135 connected together, the receiver tube 125 delivers the output of receiver component 160 to the eardrum.

In another embodiment, circuit holder 155 also holds a pierced ear stud-pin 205 in place. The adjustable stud-pin 205 fits into a vertical slot 210 on housing 135. The stud pin 205 is able to move vertically in vertical slot 210 providing flexibility in where the apparatus will connect to the wearer's ear. When circuit holder 155 is snapped into housing 135, the backside of circuit holder 155 places pressure on head 215 of stud-pin 205. The pressure of housing 135 and circuit holder 155 together inhibit the movement of the stud-pin. Thus stud-pin 205 is held snug but is still able to be adjusted vertically.

Alternatively, referring to FIGS. 2A–2E, stud-pin 205 has a give-way feature that allows the stud-pin to change its orientation if housing 135 suffers a sharp impact due to an impact such as a fall or a accidental nudging. The give-way stud-pin is able to change its orientation because its head 215 has a ball shape. The give-way head is able to move vertically in slot 210. With the give-way head at any one point in the slot, the give-way stud-pin is able to trace nearly a half-sphere of freedom of movement, providing an additional margin of safety against injury. Preferably, circuit holder 155 then also has a ball-accepting groove 212 that corresponds to groove 210 of the housing. As described earlier, when the circuit holder is attached to the housing, head 215 encounters resistance from the housing and circuit holder. The resistance is sufficient to secure the housing to the earlobe under regular use but is insufficient to hold the stud-pin so rigidly as to lead to injury to the earlobe in the event of a fall or a snag.

FIG. 2H shows a housing 135 with a rear mount housing stud-pin groove 206 that can hold the stud-pin 206 in place. Stud-pin groove 206 has a flared opening 206 at its base. That flared opening 207 allows stud-pin ball 215 to pass through the flared opening 207 and into the stud pin slot 206 by pushing the stud pin upwards with moderate force. Once the stud-pin 205 is seated into stud-pin slot 206, it will not move or disengage until a downward force is placed on the stud-pin. Stud pin groove 206 can be preformed into the housing 135 in the form of a "bath tub" shape. Ridge 209 can extend over the bathtub shape of the stud-pin groove 206 and exert a force upon the stud-pins ball head 215, as shown in FIG. 21. When the stud-pin 205 is assembled in the stud-pin groove 206, the position of the stud-pin 205 can be adjusted to any position and held in place by the force of ridge 209 on stud-pin head ball 215. The stud-pin ball 215 when held in place will not move without application of a moderate force. Of course, when subjected to a moderate or greater force, from any direction, the stud-pin ball 215 can rotate or move within the stud-pin groove to attenuate any force transmitted to the wearer's ear lobe and reduce injury. FIG. 2H also illustrates the vertically adjustable ear lobe clip 213. This clip can include a ball head 215 attached to the clip that will function as described for the stud-pin above.

FIG. 2J illustrates another alternative embodiment where multiple holes 208 are formed into the housing 135. These holes may be arrayed in any matrix convenient, but are indicted in a linear matrix in FIG. 2J for convenience. The stud-pin 205 fits into the hole 208 that is best aligned with the wearer's ear piercing. The stud-pin can be secured or stabilized by the force or pressure of the circuit holder on the stud-pin ball head 215 as previously described.

Figure 2A:
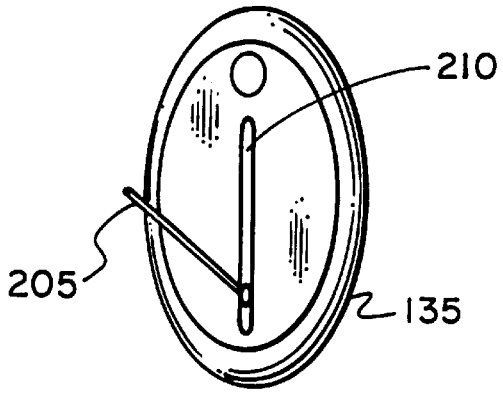
FIGS. 2A, 2B and 2C are diagrams, each diagram showing one embodiment of a stud-pin and show examples of how the stud-pin can be disposed within the housing.
Figure 2B:
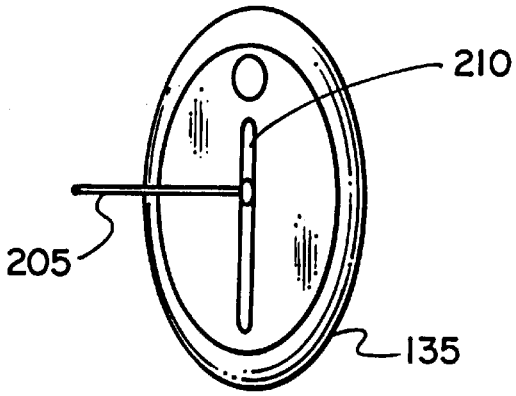
Figure 2C:
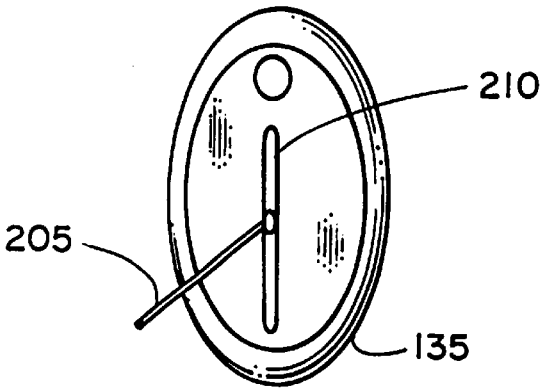
Figure 2D:
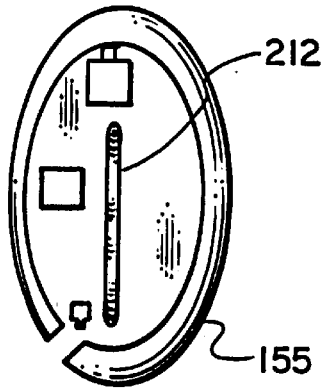
FIG. 2D is a diagram of one embodiment of a circuit holder.
Figure 2E:
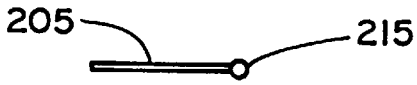
FIG. 2E is a diagram of one embodiment of a stud-pin.
Figure 2F:
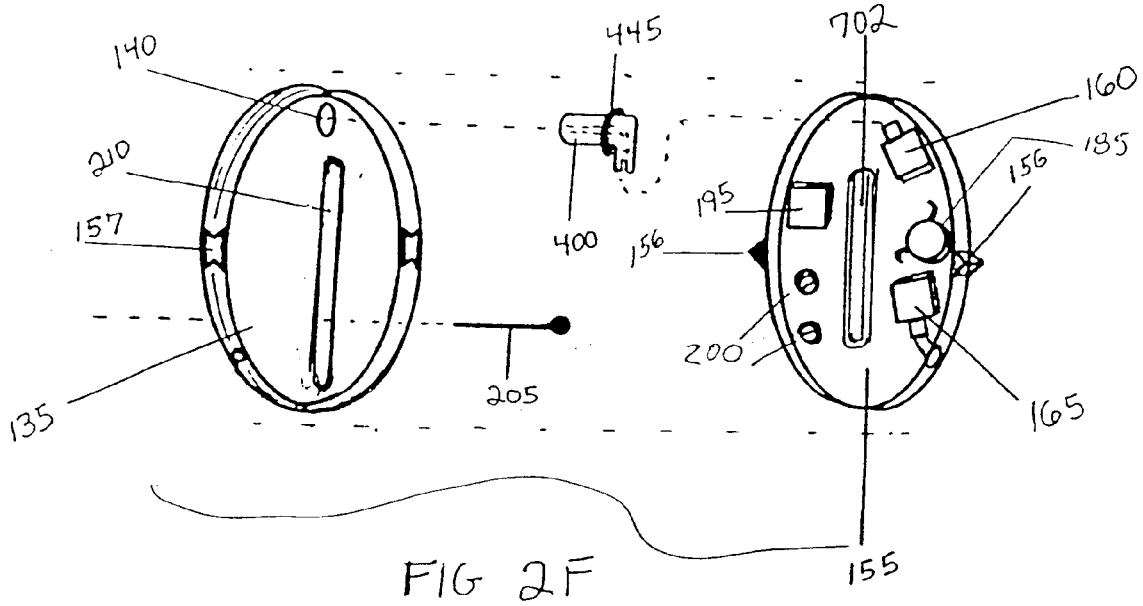
FIGS. 2F and 2G are diagrams of the disassembled housing and circuit holders according to the invention.
Figure 2G:
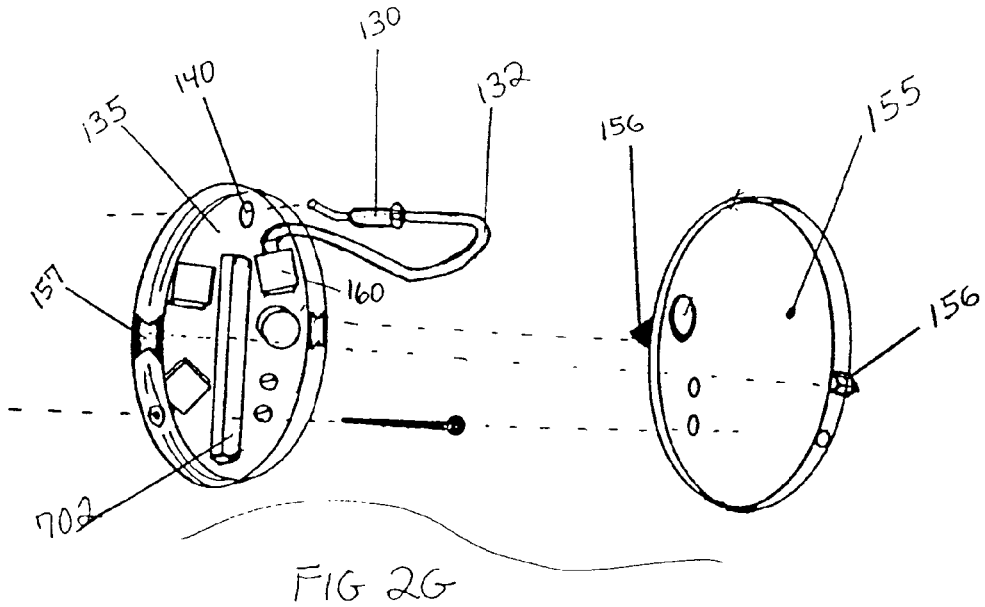
Figure 3:
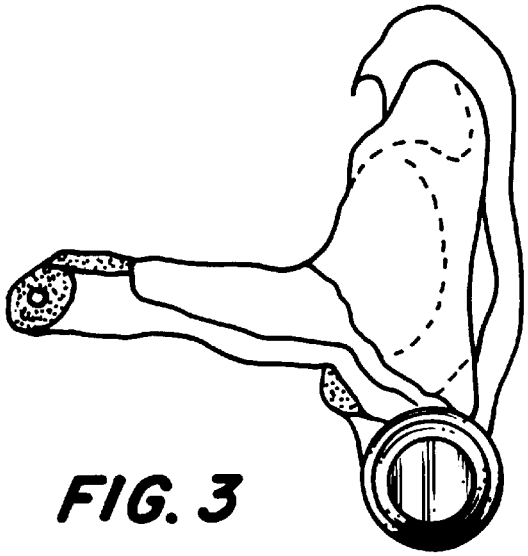
FIG. 3 is a view of one embodiment of the invention as seen on the wearer's ear.
Figure 4A:
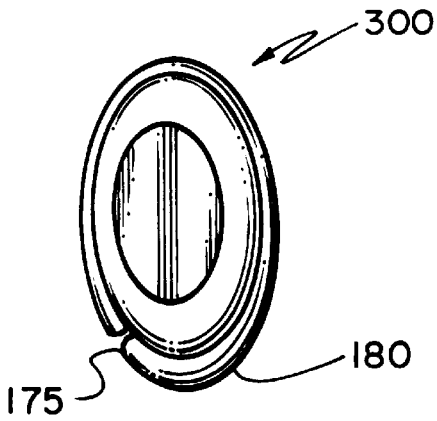
FIGS. 4A and 5A are both front views of one embodiment of housing covers according to the invention.
Figure 4B:
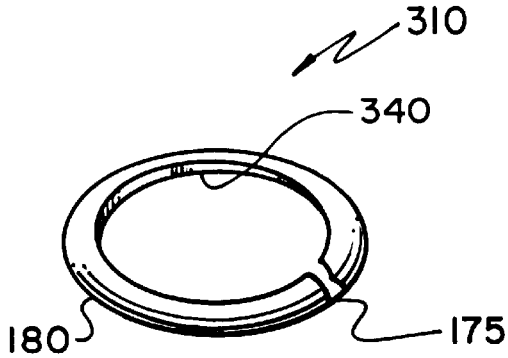
FIGS. 4B and 5B are rear views of housing covers according to the invention.

FIG. 2G shows one embodiment of how circuit holder 155 and housing 135 are removably insertable. The housing 135 holds all the electronic circuitry. The circuit holder 155 here is effectively a circuit cover. Note however, that three apertures are provided in the circuit cover. Two of the apertures provide access to potentiometers 200, an the third aperture provides access to battery 185. Alternatively, no apertures need be provided as the cover is removable. The circuit holder 155 and housing 135 lock together using the bendable clips 156 which are removable after insertion. The clips 156 fit into two female openings 157 of housing 135. FIG. 2F also shows the use of bendable clips 156, but the electronic components are bonded in place inside the circuit holder 155.

FIG. 2G also shows one embodiment of how breakaway connector 130 and receiver 160 are connected to form a conduit. The receiver tube 132 is placed over the neck of the receiver and then inserted through the hollow breakaway connector. The slack receiver tube 132 is pulled taught, through aperture 140 of housing 135 and then the excess receiver tubing 132 is cut off at the nipple end of breakaway connector 130 completing the conduit path. FIGS. 30A and 30B show alternative embodiments where a breakaway connector, 950 and 980, is disposed over the opening at the outermost portion of mold 100. The breakaway connector advantageously is bullet shaped and has the qualities described herein. In this embodiment, the breakaway connector is received by a female receptacle, 960 and 970, that is disposed on housing 135. The female receptacle can be inserted into an aperture in housing 135 designed to receive and hold the female receptacle. Alternatively, the female receptacle can simply have its outer surface connected to the surface of housing 135. For example, the female receptacle can be connected using rubber cement or some other contact adhesive that would hold the female receptacle in a position resulting in the female receptacle being prone to receive the breakaway connector.

FIGS. 4A, 5A and 4B, 5B illustrate exemplary front 300, 320 and rear 310, 330 views, respectively, of cover 180. The cover attaches to housing 135 preferably by screwing onto the housing with grooves 340, 350, the grooves being similar those on a bottle cap. The cover is half of a set that also includes a matching actual earring that is worn on the unaided ear to complete the appearance of a set of earrings. In a preferred embodiment, the cover is selected from a collection of interchangeable covers, each of which makes up a set with a matching actual earring. The collection is provided so that the wearer is able to change the appearance of the apparatus on a regular basis. For example, the wearer is able to don a different cover and matching earring each day, which gives the appearance of simply wearing a different set of earrings each day. In another example, when the wearer has an occasion to change clothing from daytime clothing to evening wear, the wearer is able to also change from one cover and matching earring set to another so that the style of clothing attire may be reflected in the choice of cover and matching earring set.

Alternatively, the actual earring can have an interchangeable face plate that is similar in size, shape and appearance to a corresponding cover of the apparatus. Thus, rather than having an individual earring to compliment each cover of the apparatus, only one earring would be required. In this case, the earring face plate and corresponding cover could be utilized as interchangeable sets having the same effect of varying aesthetical appeal.

Figure 5A:
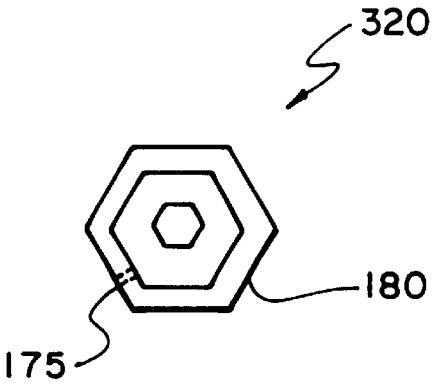
Figure 5B:
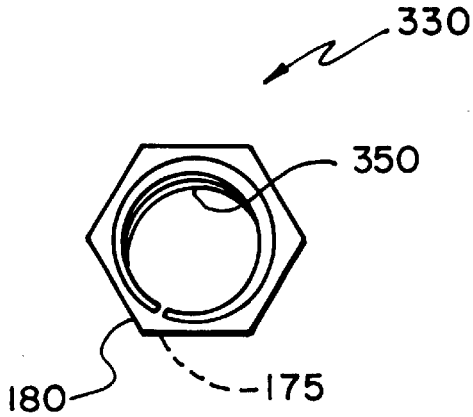
Figure 5C:
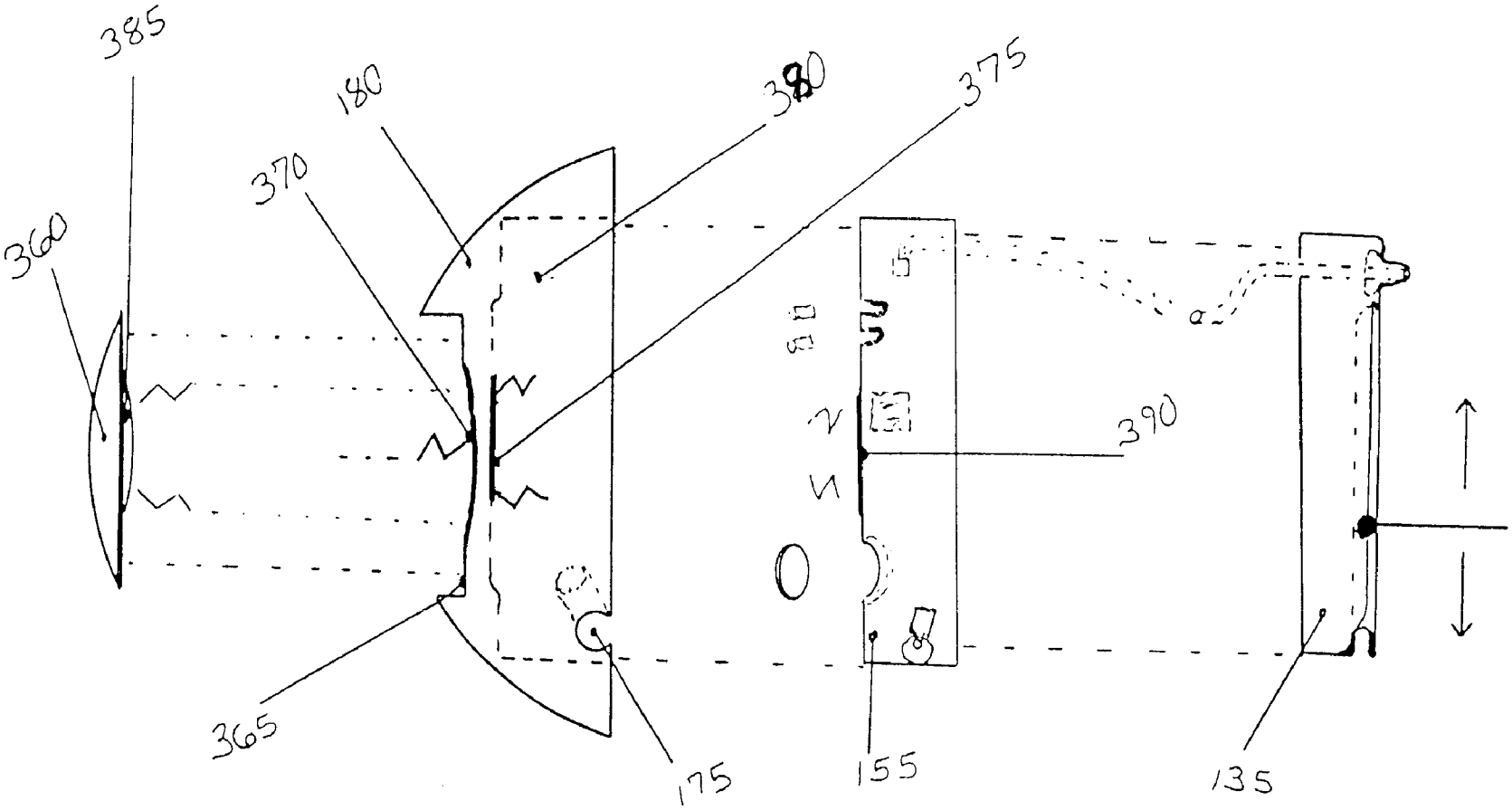
FIGS. 5C and SD are an illustration of another embodiment of housing covers and decorative elements according to the invention.

FIG. 5C shows a disassembled cross sectional view of the jewelry cover 180, the circuit holder 155 and the housing 135. Magnet to magnet, or magnet to metal attractions can be used to the jewelry cover 180 to the circuit holder 155. These magnets will simplify the use of interchangeable covers. The jewelry cover 180 can include one or more preformed magnet cavities 365 with a magnet 370 disposed therein. A decorative element 360 could, alternatively contain a magnet 385. When the decorative element 360 is nested into the jewelry cover's cavity 365 magnetic attraction, either from opposing magnetic fields, or from magnet to metal attraction, will hold the decorative element 360 securely in place, but will allow the decorative element to be changed to another decorative element having a different appearance.

Similarly, the jewelry cover 180 and the circuit holder 155 can be joined by magnetic attraction. The jewelry cover 180 can define one or more cavities 380 each containing a magnet 375. When the jewelry cover 180 is fit over circuit holder 155, then the magnets 375 and 390 are nested together and hold the two components together securely.

Figure 5D:
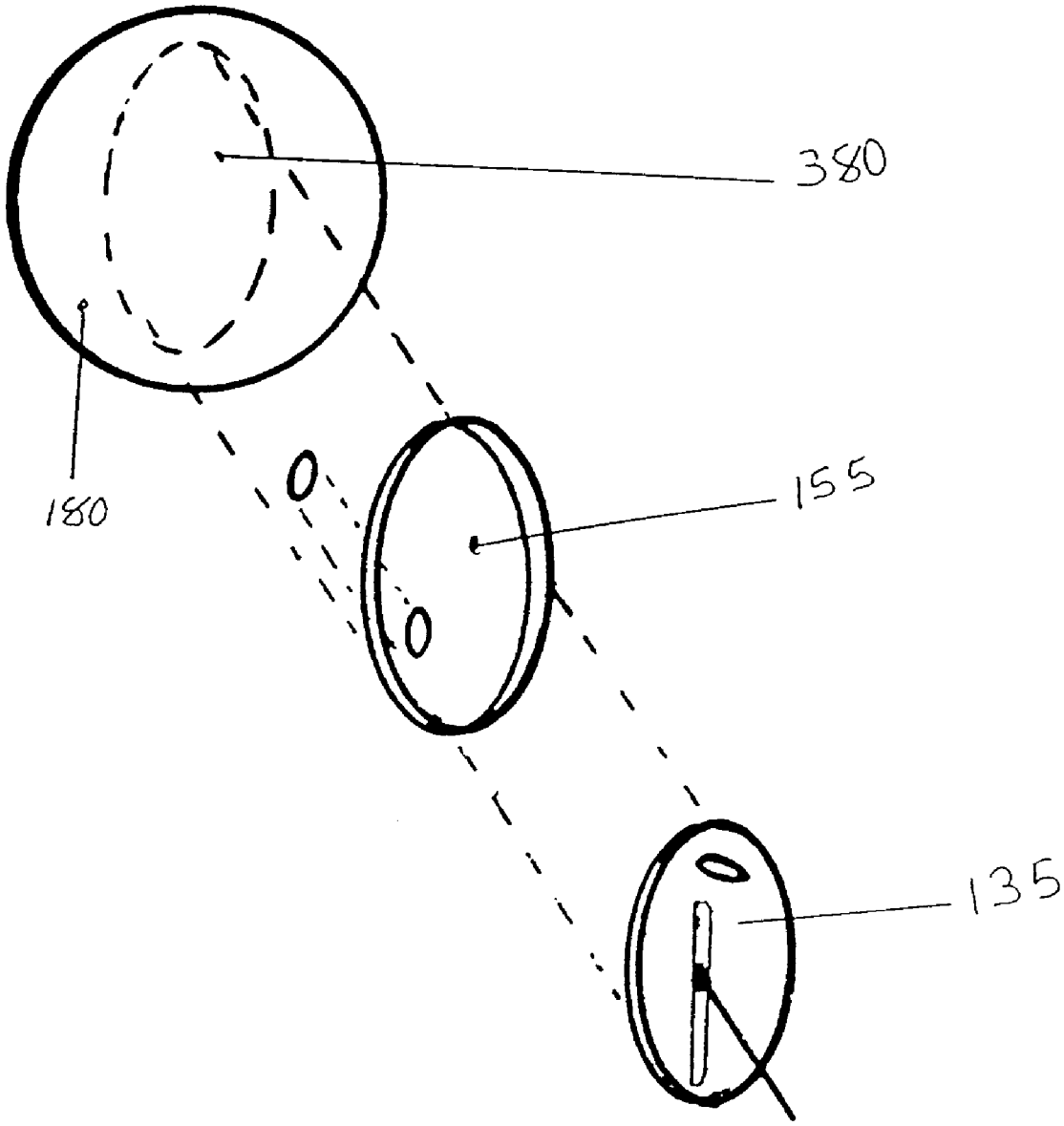
FIGS. 5E and 5F are graphs of data reflecting the performance of a hearing aid according to the invention.

FIG. 5D shows use of magnets to allow an easy connection of an oval circuit holder 155 and an oval housing 135 to a round jewelry cover 180 by use of a jewelry cover magnetic cavy. This use of magnetic attraction can eliminate the use of a mechanical attachment, such as a screw on system that can require very fine motor control.

Figure 5E:
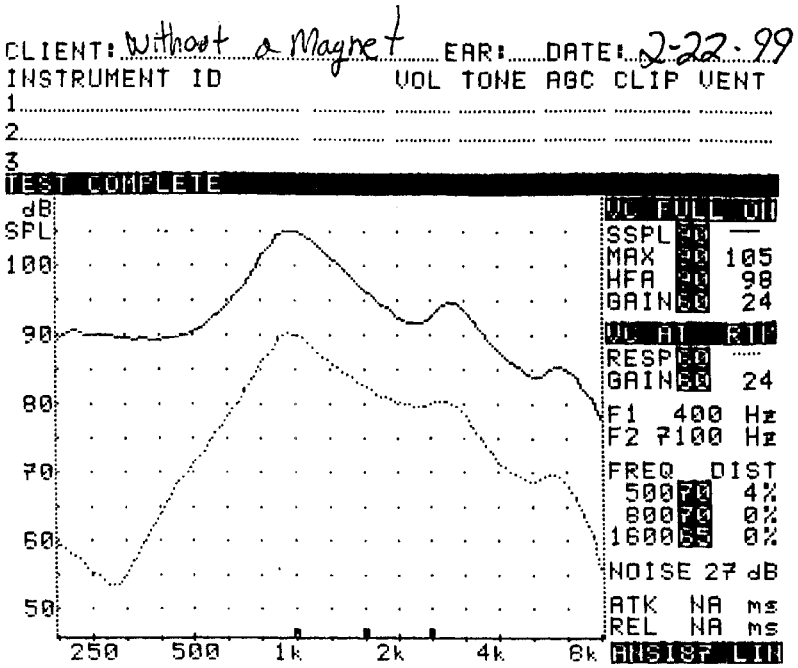

FIG. 5E shows a computer ANSI measurement test of an earring hearing aid without any magnetic field inside the Real Ear measurement box.

Figure 5F:
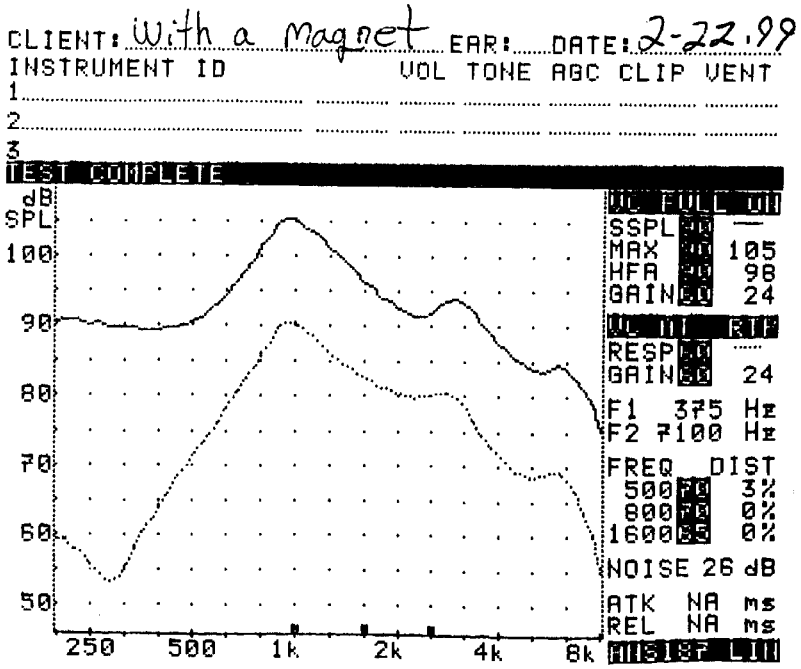

FIG. 5F shows a computer ANSI measurement test of an earring hearing aid with a large magnet placed on top of the hearing aid, inside the Real Ear measurement box. These results illustrate that the magnetic field does not have an substantial effect on the performance of the earring hearing aids.

Each cover preferably has opening 175 so that the cover does not block the microphone sufficiently to impair the operation of the hearing aid. In a preferred embodiment, each cover is made from one of the following materials or a combination: injection-molded plastic, metal, wood, and gemstones. In general, each cover may be made from any material that is appropriate for constructing an earring and may take any shape that provides for attachment to housing 135, at least one microphone opening and the desired concealment of the apparatus. Other than these noted limitations, and weight and size limitations, the design potential is plentiful. Size, shape, color, are all variables that can be varied to create a multitude of appearances that the apparatus and its accompanying earring can employ.

Figure 6:
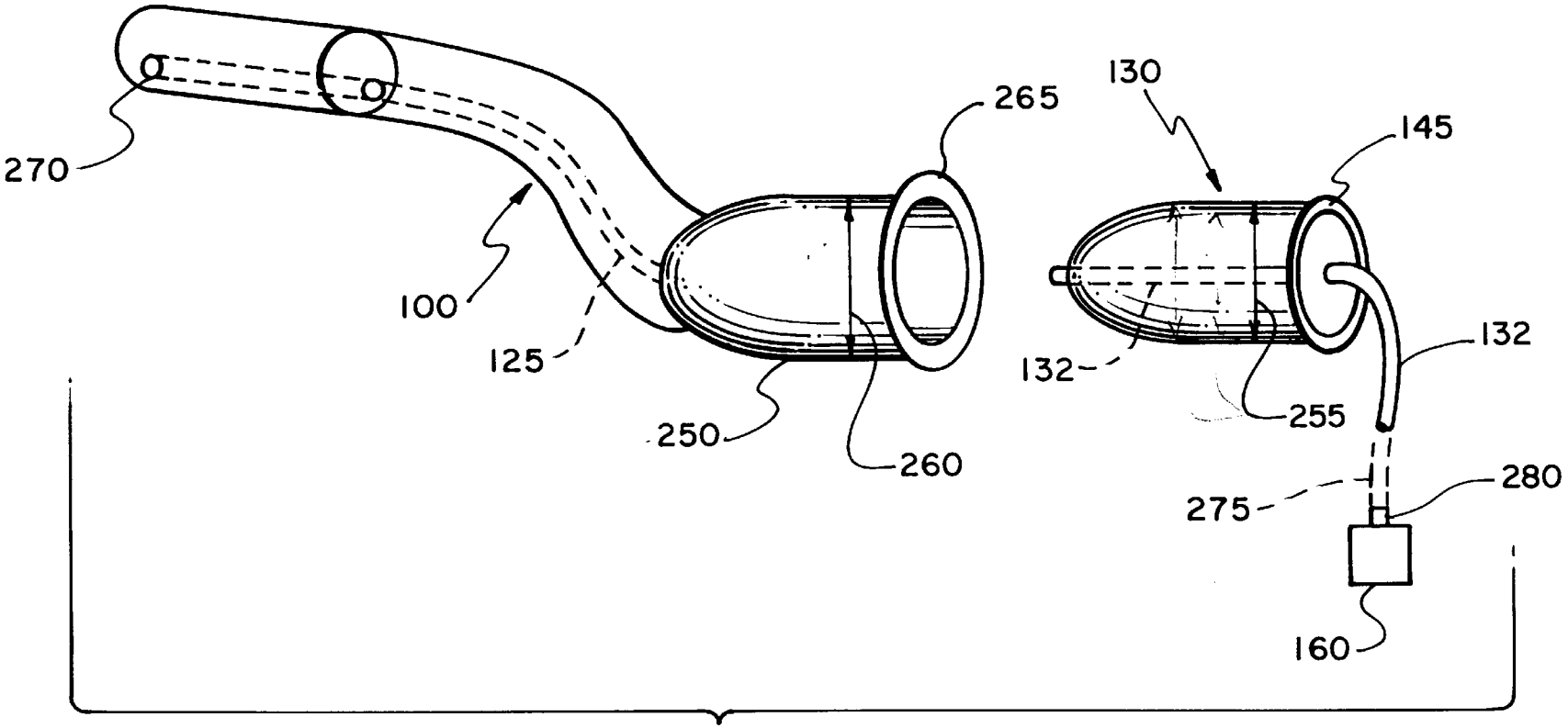
FIG. 6 is a diagram of one embodiment of a disassembled hearing aid connector according to the invention.

Turning now to FIG. 6, one embodiment of breakaway connector 130 and its connection to mold 100 and receiver 160 is shown. In this embodiment, mold 100 includes an entrance 250 that receives breakaway connector 130 to connect receiver tube 125 to extension 132. The breakaway connector 130 is small, preferably about 0.375 inches in length, and has a bullet shape that allows the breakaway connector to slide into entrance 250 much as a plunger slides inside a syringe housing. As shown in FIG. 6, the bullet shape of the breakaway connector results in nearly all of the breakaway connector having a diameter 255, preferably about 0.25-inch. Diameter 255 is substantially the same as diameter 260 of the entrance 250. Thus, even if breakaway connector 130 is inserted only partially into entrance 250, the resulting seal between the breakaway connector and entrance is sufficient enough to allow the output of the receiver 160 to be workably delivered through the breakaway connector to receiver tube 125.

It is to be appreciated that the bullet shape of breakaway connector was chosen for its high insertion reliability as well as its flexible-collapsible qualities. However, other shapes can serve a similar purpose. For example, a mushroom shape where the stem of the mushroom would collapse into the cap of the mushroom when impacted. The cap of the mushroom having further collapsible qualities and being coupled to receiver tube 125 and the stem being coupled to the output of receiver 160. Similarly, a triangular shape where the point of triangle would couple to receiver tube 125 and the triangle base opposite that point being coupled to the output of receiver 160. An impact causing the adjacent sides to collapse as the base was forced towards the point. Regardless of the shape of the breakaway connector, it must have qualities of being flexible and collapsible to achieve the objectives of the invention. Of course the output signal of the hearing aid must also be able to be conducted through the breakaway connector as well. Those skilled in the art will recognize various shapes constructed from various materials to use the invention as described herein.

Preferably, breakaway connector 130 is inserted fully into entrance 250. To aid insertion, a receiving ridge 265 is provided about the opening of entrance 250. The receiving ridge operates much like a funnel such that the breakaway connector is guided into the entrance. Thus, a breakaway connector that approaches the entrance in a slightly misaligned fashion is guided by receiving ridge 265 into improved alignment, allowing proper insertion. When the breakaway connector is fully inserted, the output of receiver 160 is able to travel through tube extension 132 and subsequently through receiver tube 125, arriving at a point 270 proximal to the eardrum. It should also be appreciated that breakaway connector 130 can simply have the outer surface of its nipple end abutted against the opening at the outermost portion of mold 100.

As shown, the output of receiver 160 is connected to the breakaway connector with a connecting portion 275 of extension tube 132. The connecting portion 275 fits snugly over an output port 280 of receiver 160 much as a sleeve fits over a tube. Preferably a rubber jacket is then placed over receiver 160 to prevent internal feedback and leakage. Another rubber jacket is preferably used near microphone 165 (FIG. 7) for the same purpose.

In this embodiment, entrance 250 is preferably made with a combination of acrylic and vinyl-flex such that the entrance is (1) soft enough to avoid damage to the ear, as mentioned above, and also (2) strong enough to structurally receive breakaway connector 130. Those skilled in the art will recognize other materials that provide similar flexibility and strength. Any such material can be used to construct entrance 250.

In FIG. 7, one embodiment of circuit holder 155 is shown from a normal view 162, and a similarly oriented but transparent view 167. As shown in normal view 162, only potentiometers 200, battery 185, and battery terminals 190 are visible. These visible parts are preferably of rugged construction. As shown in normal view 167, circuit holder 155 includes microphone 165, amplifier 195, and electronic receiver 160. The position of each component is selected with feedback considerations in mind. Those skilled in the art will recognize many possible configurations of component layout given the size and double-sided nature of circuit holder 155.

Figure 8:
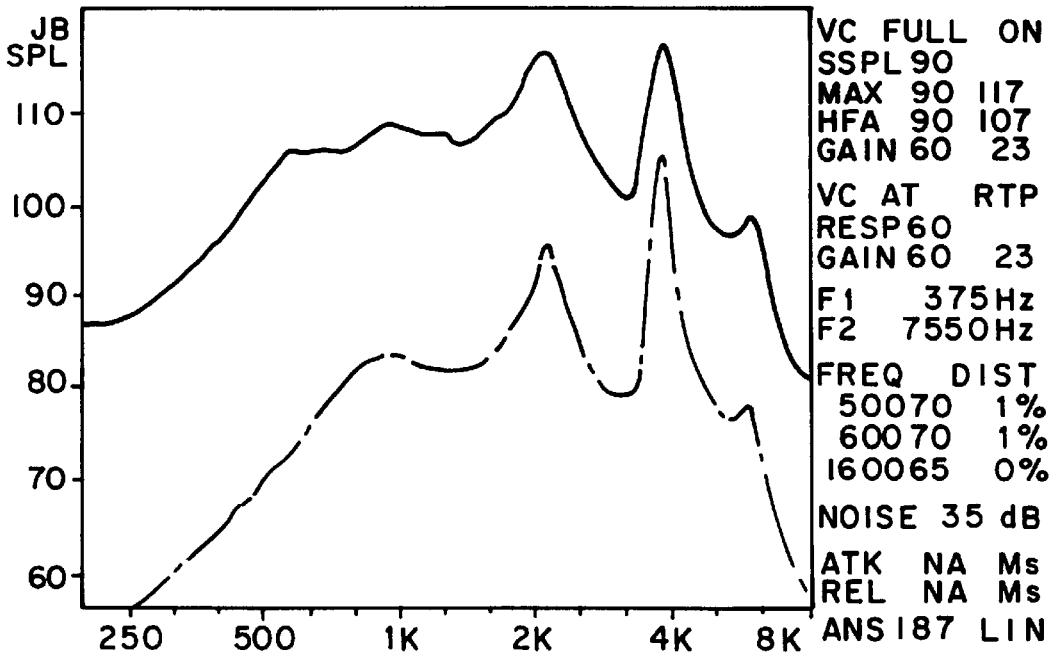
FIGS. 8 and 9 are graphs displaying exemplary results of tests of a hearing aid according to the invention.
Figure 9:
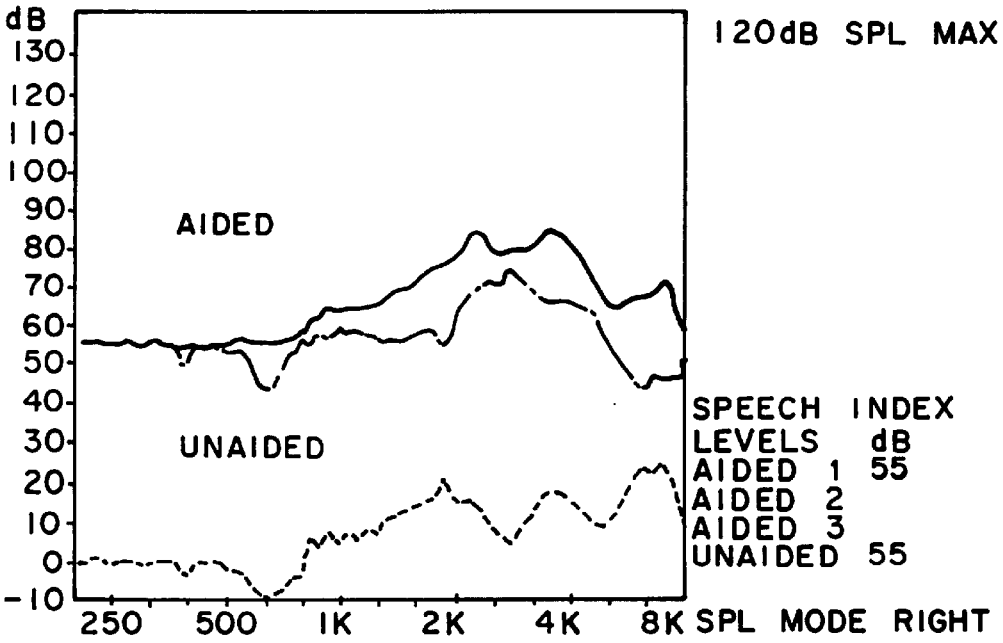

The output of tests of a hearing aid produced according to a preferred embodiment of the invention as described herein are shown in FIGS. 8 and 9. With respect to FIG. 8, subjected to an industry-standard ANSI test on a "Real Ear" computer, the hearing aid produces at least a 23 decibel (dB) gain at full volume with an audio signal that arrives at the microphone and is amplified and delivered to the eardrum. Furthermore, the hearing aid produces frequency distortions of levels 1% or less at frequencies of 500 Hz, 800 Hz, and 1600 Hz. According to industry standards, these performance levels indicate a high-performance hearing aid. With respect to FIG. 9, the performance of the hearing aid is shown contrasted with an unaided ear. In the test of FIG. 9, a test probe of the "Real Ear" computer was placed inside a human ear and readings were taken with and without the aid of the hearing aid, which was set at low volume. As shown, the hearing aid produces a significant increase in sound level at nearly all frequencies.

Figure 10:
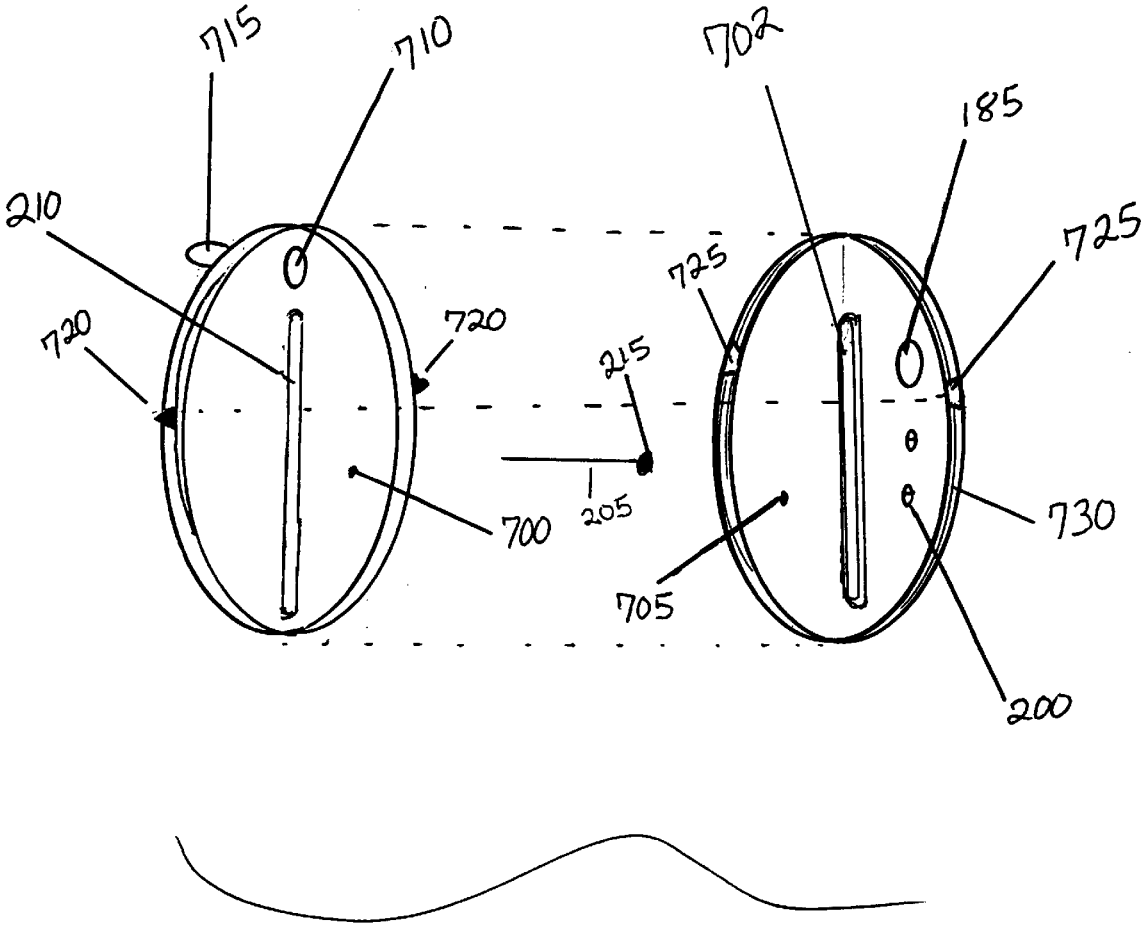
FIG. 10 is a diagram of one embodiment of a housing and circuit holder according to the invention.

FIG. 10 shows an embodiment having a one piece, self-contained breakaway connector and combined housing body. The breakaway connector has a nipple end 715 and a hollow portion 710 and is incorporated into a housing 700. The housing 700 is preferably constructed of soft rubber. The stud-pin groove 210 is formed into rubber housing 700. In this embodiment, bendable clips 720 on housing 700 correspond and snap into the hollow portions 725 of circuit holder 705. The circuit holder 705 is preferably made of a hard plastic material in order to fit over and firmly support the rubber housing 700.

In FIG. 10 and FIG. 2F the circuit holder contains a groove 702 which is formed into the likeness of a bath tub shape. This groove simultaneously guides stud-pin 205 vertically and also allows for nearly a half sphere of freedom of movement for the ball-shaped head 215 of the stud-pin. This same type of groove 702 is also shown in FIG. 2G. There, groove 702 is built into housing 135 instead of being built into the circuit holder 155. Flattening this groove allows a flat headed stud-pin to be used alternatively. In a preferred embodiment as shown in FIG. 10, circuit holder 705 has a treading 730 on its exterior perimeter. This threading can be used to hold a decorative cover in place (decorative cover not shown in FIG. 10). The decorative cover having treading on its exterior perimeter that complements treading 730 on the exterior perimeter of circuit holder 705.

Figure 11:
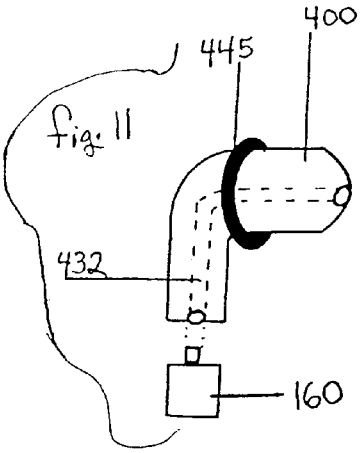
FIGS. 11–14 are diagrams of one embodiment of a breakaway connector according to the invention.
Figure 12:
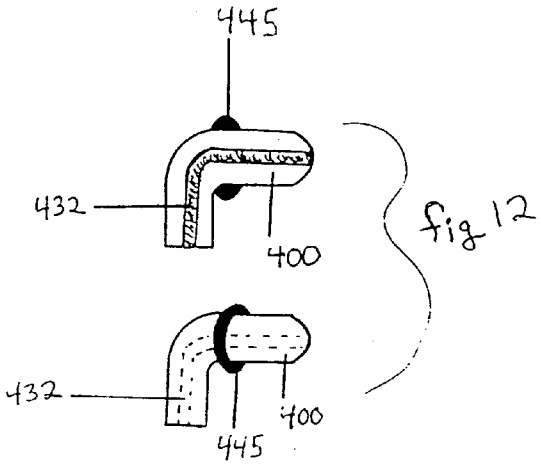

FIG. 11 shows an alternative breakaway connector 400. The receiver component 160 inserts into a preformed receiver tube 432 which firmly secures onto the neck of receiver component 160. FIG. 12 shows an alternative breakaway connector, where two connector halves are formed and then bonded together 400. A receiver tube 432 is preformed inside the connector. A preformed gasket 445 is deployed about the connector once the halves are bonded together. The gasket 445 can later be used to bond connector 400 to housing 135.

Figure 13:
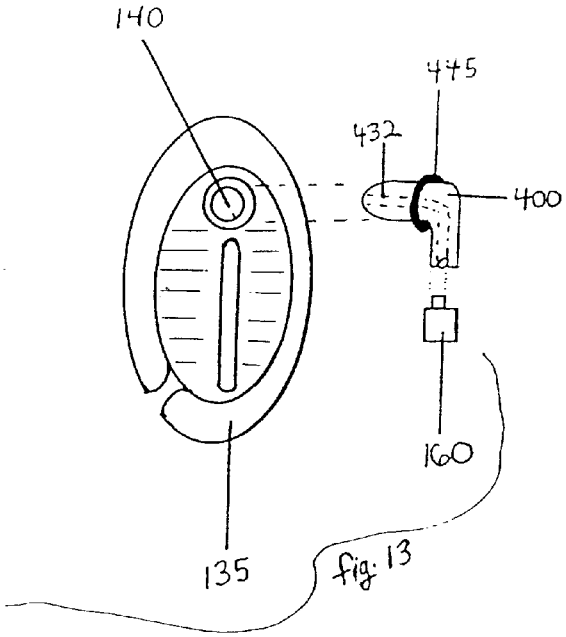
Figure 14:
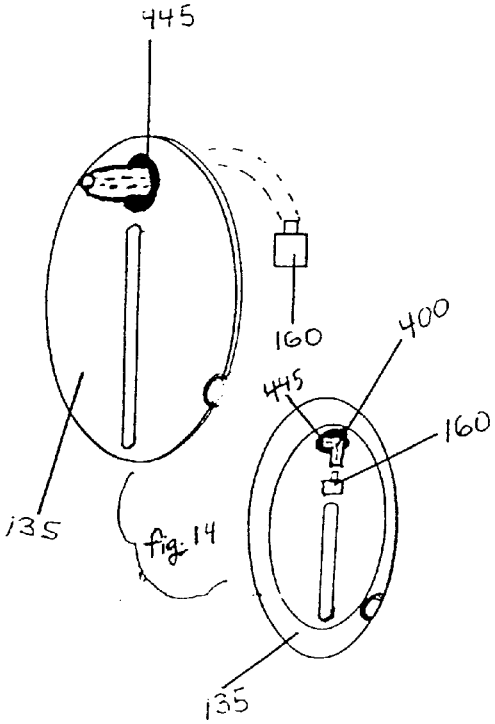

FIGS. 13 and 14 show that the breakaway connector 400 can be connected to housing 135 in a variety of ways. For example, FIG. 13 shows housing 135 having an aperture 140. The breakaway connector 400 can be inserted into aperture 140 until gasket 445 abuts the side of housing 135. The gasket 445 can be bonded to housing about aperture 140. Alternatively, breakaway connector 400 can be held in place by the pressure created from insertion into aperture 140 thereby eliminating the need to bond gasket 445 to housing 135. FIG. 14, on the other hand, shows housing 135 having a smaller aperture where breakaway connector 400 is merely disposed over the aperture such that gasket 445 circumscribes the perimeter of the aperture. In this configuration, gasket 445 would require bonding to be held to housing 135. Once breakaway connector 400 is in place over the aperture, the output of receiver 160 can be coupled to breakaway connector 400 by way of the aperture.

FIG. 17 shows one embodiment of the tongue shaped custom ear mold. The bullet shaped female receptacle 250 is preferably pre-manufactured into a one-size-fits-all soft plastic component. The custom ear mold is prepared in advance to fit the wearer as previously described according to the invention. A wearer is fitted for a custom ear mold by a qualified dispenser in the following way. First, a deep impression of the ear is made. The mold is then custom tailored from the impression. The completed custom-tailored mold is placed into the wearer's ear canal. Alternatively a bowl shaped ending 285 is added to the customizing process of ear mold 100. This bowl shape ending 285 is designed to match the external surface of the bullet shaped female receptacle 250 so the female receptacle can be bonded to the ear mold.

Figures 15, 16:
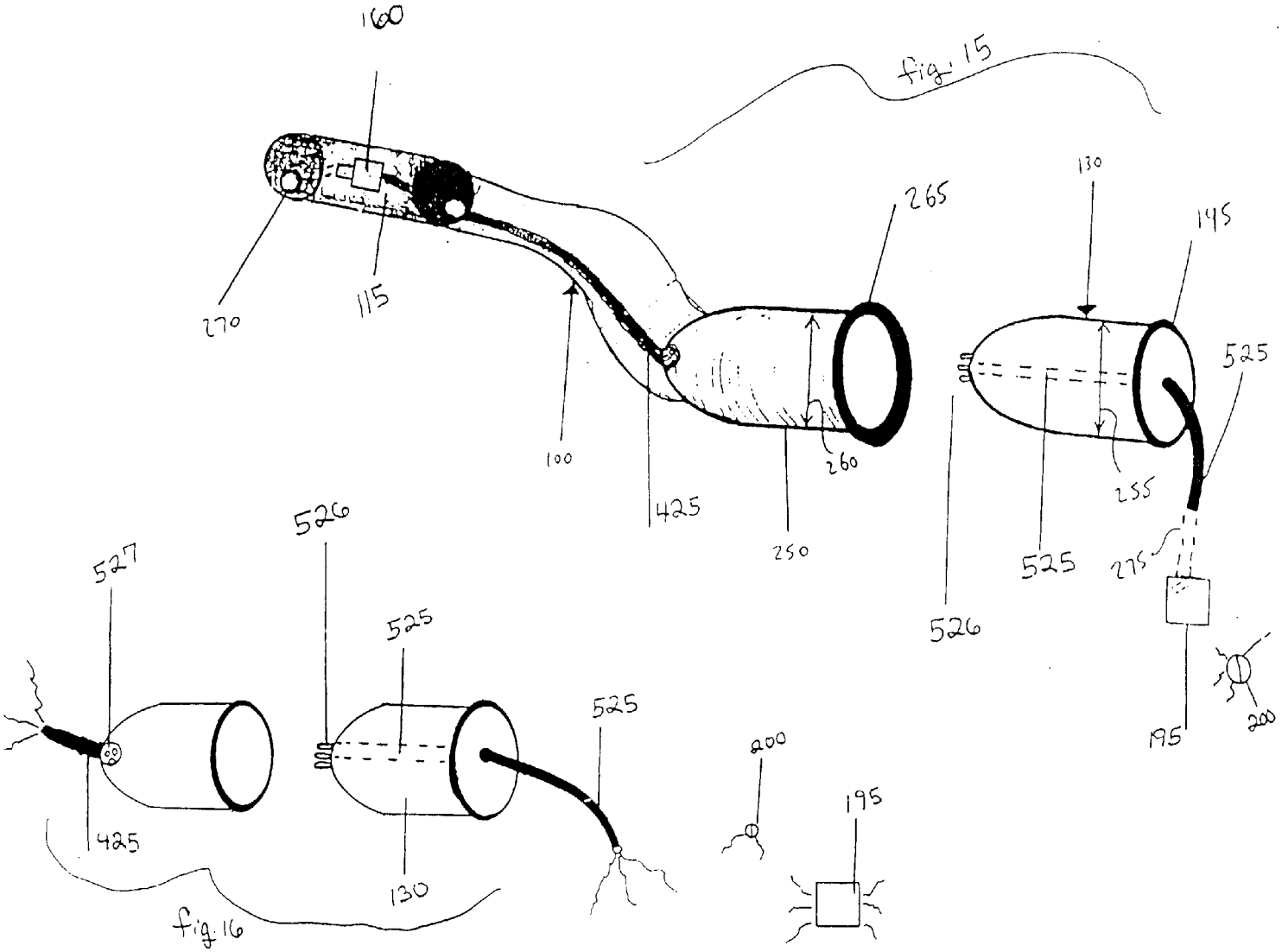

FIGS. 15 and 18 show alternative embodiments where receiver 160 is placed into the innermost portion of mold 100 near the ear drum. An electrical connection is needed which connects the electrical signal from amplifier 195, disposed in housing 135, to receiver 160. There are numerous electronic coupling means by which to implement the needed electrical connection. Several will be discussed herein.

FIGS. 15, 16 and 18 each show an embodiment of an electronic coupling means. Breakaway connector electrode 526 and ear mold electrode 527 are mated resulting in the amplified signal output of amplifier 195 being delivered to receiver 160 placed inside the ear mold 100. Electrode 526 is coupled to the output of amplifier 195 by a hard wire connection 525. The hard wire connection is preferably a grouping of individually insulated copper conductors within a single insulative jacket. The number of insulated conductors within the jacket of course depends on the number of signals being transmitted. Those skilled in the art will appreciate a variety of conventional conductors that can be used as hard wire connection 525. Similarly, hardwired connection 424 connects electrode 527 to receiver 160. Preferably, hardwire connection 424 is the same type as hard wire connection 525.

Alternatively, components other than receiver 160 can be positioned near the eardrum instead of outside the ear canal. Furthermore, the electronic coupling means need not be limited to hardwire. An electronic or optical signal may be transmitted to a location near the eardrum where the electronic or optical signal is converted to sound pressure waves. The electronic or optical signal can be analog or digital, and can be derived from a signal originating at the microphone outside the ear canal. The transmission may be implemented with the use of an electrical wire, an optical fiber, or electromagnetic waves such as radio or infrared waves. In the case of an electrical wire or an optical fiber, the breakaway connector further includes an electrical or optical connector. Those skilled in the art will recognize various conventional ways to transmit an electronic signal from one point to another.

Figure 19:
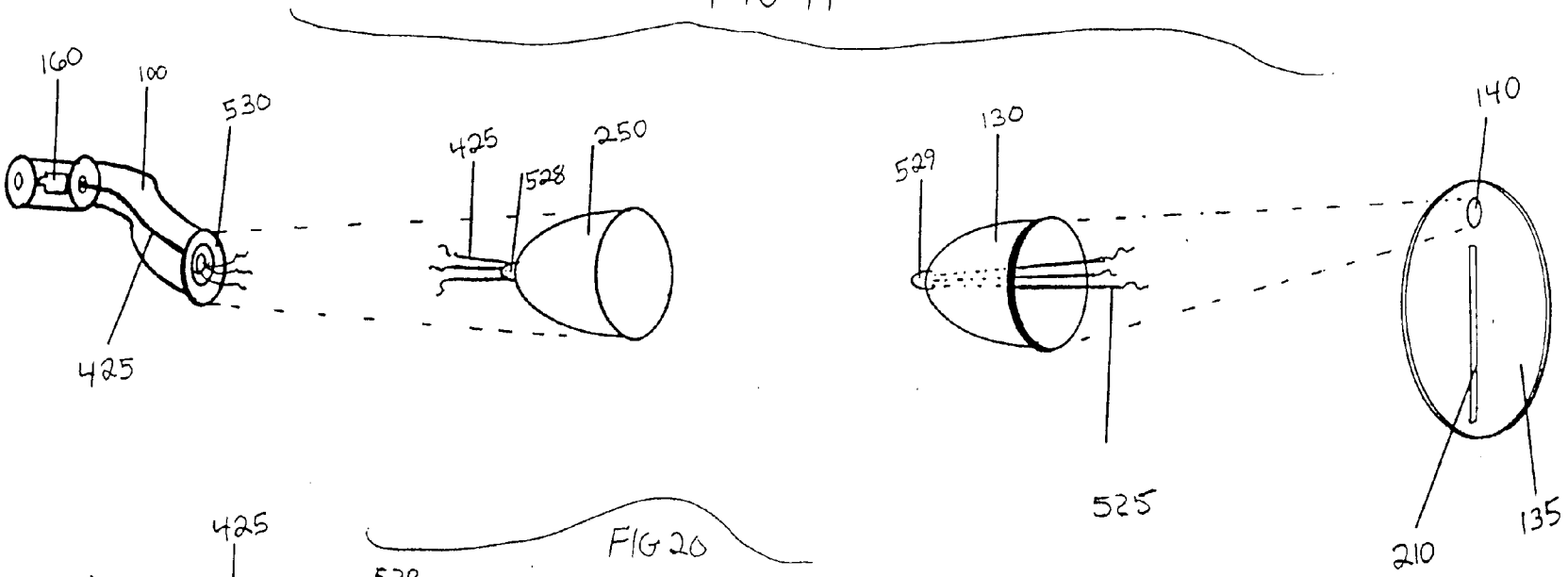
FIGS. 19–20 are diagrams of one embodiment of disassembled views of electrode connectors placed within the breakaway connector and the ear mold according to the invention.

FIG. 19 shows a view of one embodiment of an electronic coupling means. The ear mold 100 contains receiver 160. Hard wire connection 425 runs throughout mold 100 from receiver 160 placed at the innermost portion of mold 100 to bowl shaped ending 530 at the outermost portion of mold 100 and connects to electrode 528 disposed in the tip of female receptacle 250. Female receptacle 250 is bonded to bowl shaped ending 530 at the outermost portion of mold 100. A breakaway connector 130 contains hard wire connection 525 which connects the amplified signal output of amplifier 195 to electrode 529 disposed in the tip of breakaway connector 130 In this embodiment, amplifier 195 is disposed in the housing and hard wire connection 525 travels through aperture 140 to connect the signal output of amplifier 195 to electrode 529. Female receptacle 250 and breakaway connector 130 are similarly constructed as earlier described, having the additional feature of electrodes 528 and 529 bonded to their respective tips.

Figure 20:
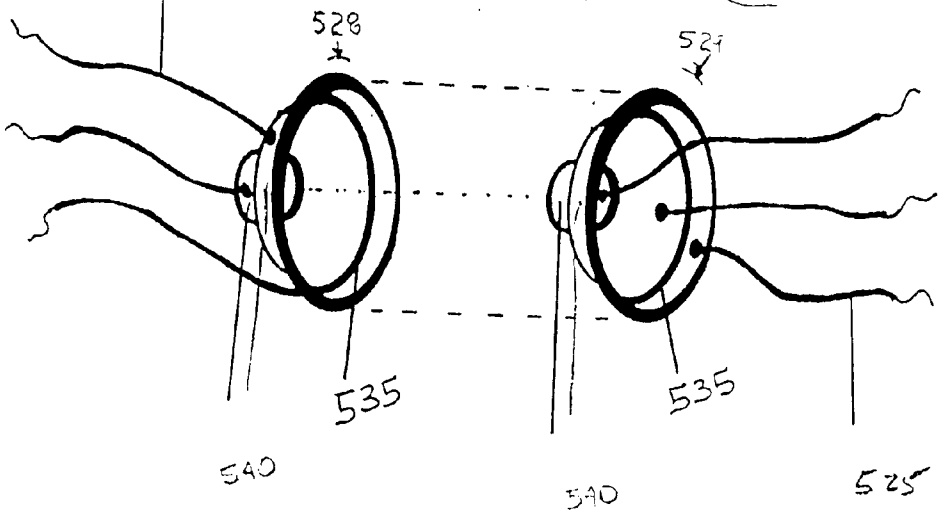
Figure 8:
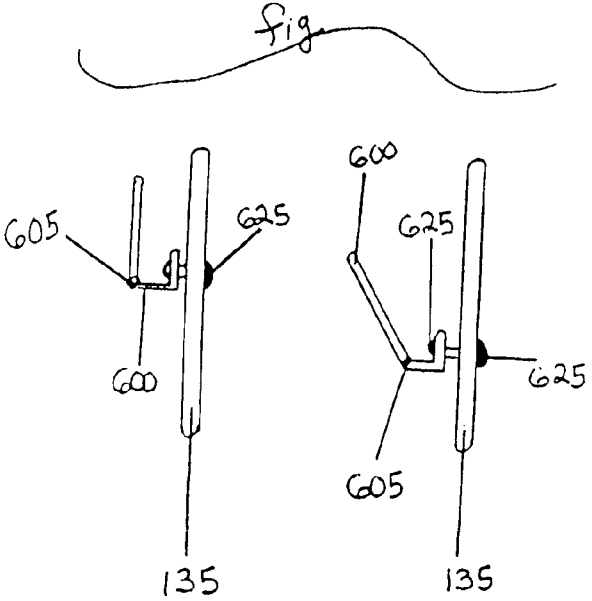
Figure 9:
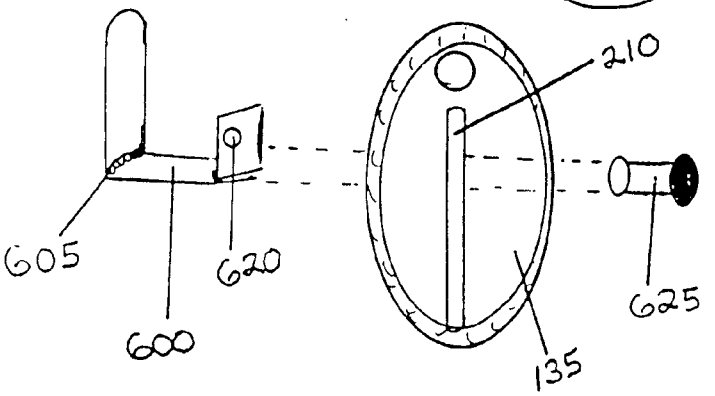

FIG. 20 shows a detailed view of one embodiment of the two electrodes 528 and 529. The electrodes preferably nest into each other as shown, and have two conductive bands 540 isolated by an insulative band 535. Preferably, conductive bands 540 are copper, but other conductive materials will suffice. The insulative bands 535 are preferably rubber, but other insulative materials will suffice. Conductive bands 540 are bonded to insulative band 535 thereby forming multiple but separately insulated electrical connectors. When the two electrodes are nested into each other, the amplified signal output of amplifier 195 is conducted to receiver 160. Those skilled in the art will recognize various other conventional types of electrode configurations that will provide the necessary number of conductors for transmitting electrical signals from amplifier 190 to receiver 160. It will be further appreciated that the breakaway nature of the electrode configurations gives rise to certain limitations. For example, once the two electrodes are nested together, the force that is required to separate them cannot be so great that damage to the wearer's ear would occur before the electrode connection was broken. At the same time, the electrodes must make a good electrical connection so that the hearing aid will function properly.

The invention includes an additional feature for women who do not have pierced earlobes. FIG. 21 shows one embodiment of a vertically sliding, clip-on earlobe fastening system. The sliding groove 210 on housing 135 accepts a rivet 625. When rivet 625 passes through both groove 210 of housing 135 and opening 620 of clip 600, then rivet 625 can be crimped under pressure. All the pieces are joined with just enough pressure where the clip is vertically adjustable but also holds itself firmly in place.

FIG. 22 shows a preferred embodiment of clip 600 where the clip contains a flexible and/or moveable retaining spring or similar pressure applying system 605 which holds clip 600 firmly to the earlobe of the wearer. The left side of FIG. 22 shows clip 600 in a working state and the left side shows the clip in a state of rest.

Figure 23A:
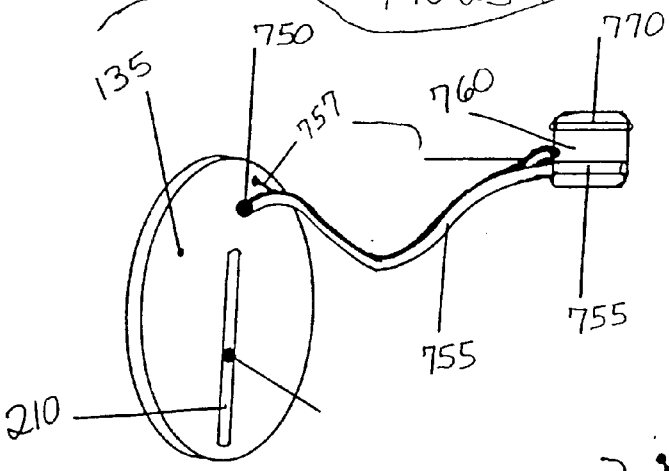
FIG. 23A is a diagram of one embodiment of an ear mold and an ear mold retrieval system according to the invention.

FIG. 23A shows one embodiment of a Completely-In-The-Canal (CIC) air conduction style ear mold 760 and ear mold vent 770 attached to housing 135. A removable conduit 775 works simultaneously as a conduit to direct the sound pressure from receiver 160 (placed inside the housing 135) to the ear mold 760 (placed in the proximity of the eardrum) and also works as a flexible removal handle. In a preferred embodiment, removable conduit 755 is secured to housing 135 at point 750. The removal conduit 755 has built-in slack, and will give way in the event of an impact to the ear. The removal conduit 755 works like a ball and chain so that when pressure is placed onto removal conduit 755 the CIC ear mold 760 will be pulled out and away from the eardrum less abruptly. The removal conduit 755 has a pre-formed shape and springs to that shape is stretched or pulled into a different shape. This memory action results from fitting tube 755 around a modified human ear mold impression and then heating and cooling tube 755 until it conforms to the shape of the wearer's lower concha bowl and auditory canal. This technique helps conceal the entire CIC and the ball and chain connecting system from plain view. The memory action creates a housing retention pressure which holds housing 135 somewhat firmly against the intertragic notch of the wearer's pinna and simultaneously provides the give-way feature.

Figure 23B:
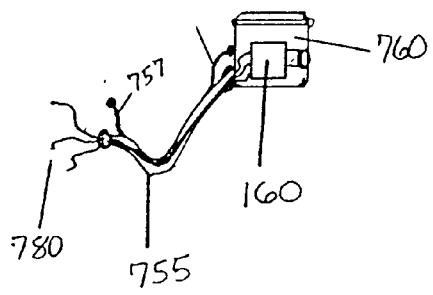
FIG. 23B is a diagram of one embodiment of a disassembled view of a reinforced ear mold and retrieval system according to the invention.
Figure 23C:
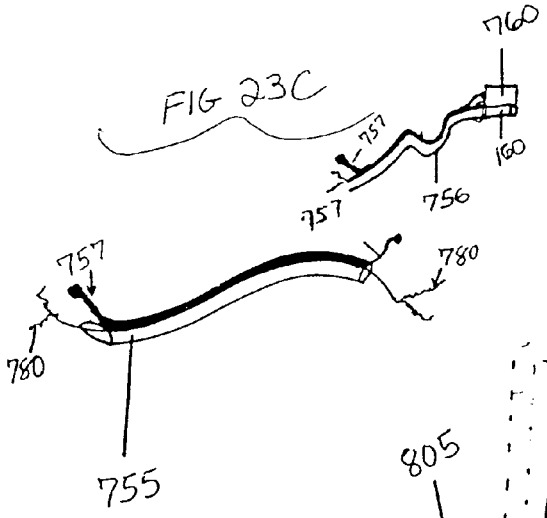
FIG. 23C is a diagram of one embodiment of a disassembled view of a reinforced ear mold and retrieval system according to the invention.

FIGS. 23A, 23B and 23C all show one embodiment of a flex line 757. The flex line preferably has a fishing line strength, and is affixed into removal conduit 755 during it's manufacturing. Alternately, the flex line can be bonded to removal conduit 755 after the conduit is manufactured. A short section of flex line 757 is sliced and loosened at each end of removal conduit 775 so that the short section of flex line flares away from removal conduit 755. The flex line 757 is then cut slightly shorter than removal conduit 755. In FIG. 23A, one end of flex line 757 is attached to housing 135 and the other flex line ending is attached to CIC ear mold 760. The end result is that the flex line endures most of the wear and tear of the constant tugging during the removal process and the flex line can be attached to the center portion of the CIC ear mold which will allow a more even torque.

FIG. 23B shows an alternative CIC with ball and chain design where receiver 160 is completely removed from housing 135 and is placed into CIC ear mold 760. The removable conduit 755 is used simultaneously as a housing for a hardwire 780 which supplies receiver 160 with the amplified signal output of amplifier 195. The tube 755 will hold hardwire 780 without losing its memory action.

FIG. 23C shows that the removable conduit 755 can be manufactured into a predominantly flattened shape which will align more closely to the concha bowl and the auditory canal and become less conspicuous.

Figure 24:
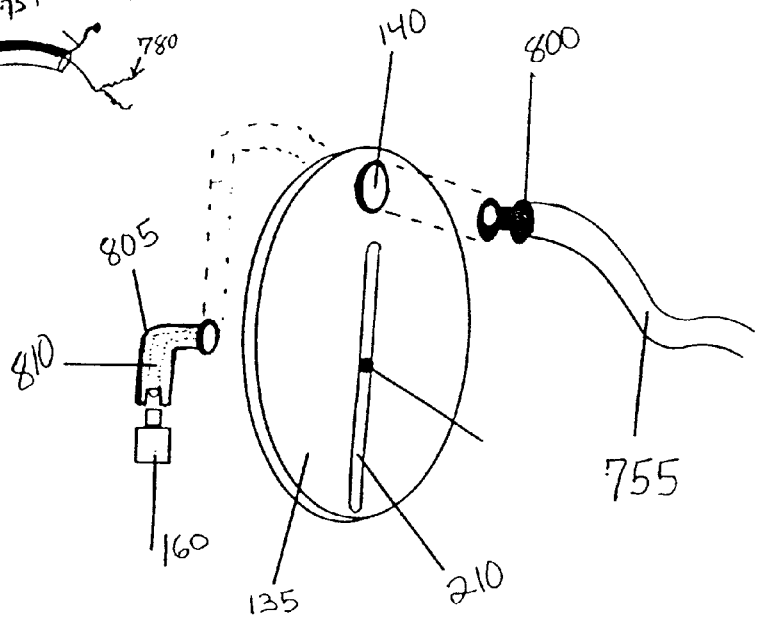
FIG. 24 is a diagram of one embodiment of a disassembled view of an ear mold and an breakaway system and an receiver connector according to the invention.

FIG. 24 shows an alternate embodiment of removal conduit 755 having a breakaway connector 800 which is connected to the end of removal conduit 755. The breakaway connector 800 is preferably made in the shape of a dumbbell but could also use a number of other shapes, for example a bullet shape. The housing 135 contains aperture 140 which allows the dumbbell shaped connector to pass through it when pressure is applied. The housing 135 or circuit holder 155 will contain a female receptacle 805 which will accept and nest with the dumbbell shaped connector and hold it in place. The female receptacle 805 contains a receiver tube 810 inside which can be coupled to the neck of receiver 160.

Figure 25A:
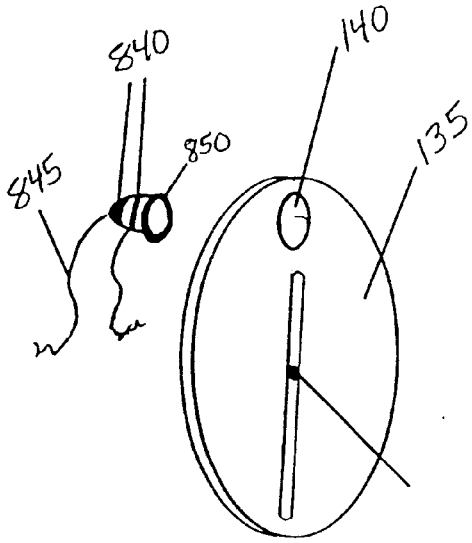
FIGS. 25A–25D are diagrams of one embodiment of a disassembled view of an ear mold and an electrode breakaway system according to the invention.
Figure 25B:
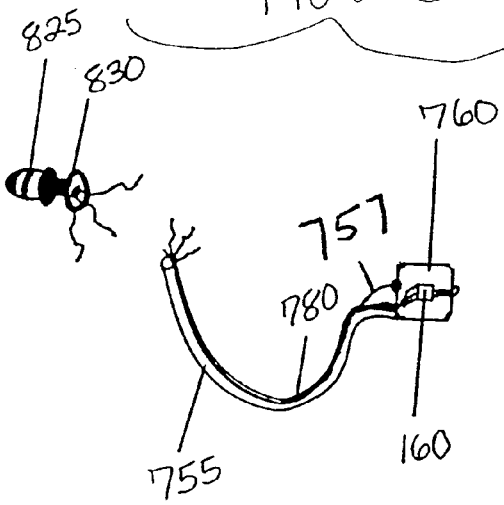

FIGS. 25A–25B show one embodiment of a ball and chain CIC ear mold working simultaneously with a housing breakaway connector 830 that employs an electronic coupling means. The breakaway connector 830 contains electrodes 825. Housing 135 contains a female receptacle 850 which contains electrodes 840. The electrodes 840 are connected to hardwire 845 which connects to the amplified signal output of amplifier 195. Breakaway connector 830 and Electrodes 825 are connected to hardwire 780 which in turn is connected to receiver 160. As described earlier, hardwire 780 travels inside removable conduit 755. The breakaway connector 830 preferably has a dumbbell shaped end, the dumbbell shaped end being bonded to an opening at the end of removable conduit 755. The breakaway connector preferably has a nipple end that is passed through aperture 140 on housing 135. The center portion of the dumbbell shape is placed in the aperture such that each end of the dumbbell shape is on opposite sides of aperture 140. The nipple end of breakaway connector 130 is received by female receptacle 850 which is bonded to the opposite side of the aperture as shown.

Figure 25C:
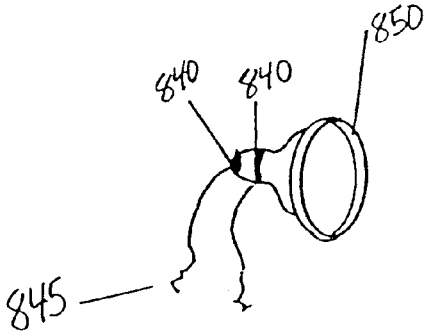
Figure 25D:
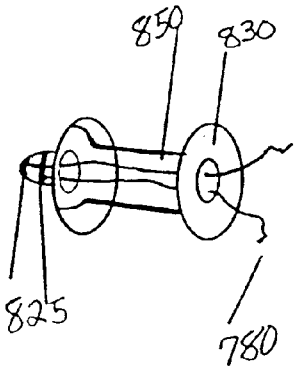

FIGS. 25C–25D show a detailed view of one embodiment of an electronic coupling means employing breakaway connector 830 and a female receptacle 850. The breakaway connector 830 preferably contains a combination of rubber o-rings and metal rings thus forming two conductive bands isolated by an inductive band. Similarly, female receptacle 850 contains a combination of rubber o-rings and metal rings thus forming two conductive bands isolated by an inductive band. When breakaway connector 830 is inserted into female receptacle 850, the conductive bands of breakaway connector 830 contact the corresponding conductive bands of female receptacle 850 thereby allowing signal conduction. Electrodes 825 are connected to hardwire connection 780 which is connected to receiver 160, and electrodes 840 are connected to hardwire connection 845 which is connected to the amplified signal output of amplifier 195.

The breakaway connector 830 is preferably inserted through aperture 140, through ridge 850 and so that breakaway connector 830 securely engages female receptacle 850. The breakaway connector 830 is preferably a dumbbell shape and held in place with half of dumbbell inside of aperture 140 and the other half outside of housing 135.

Figure 26:
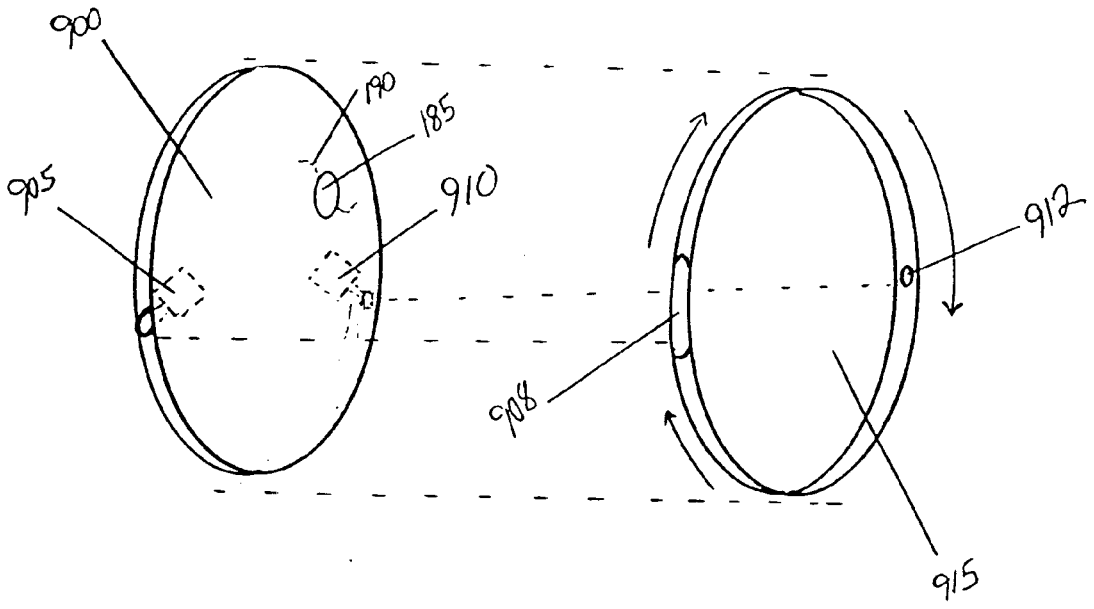
FIGS. 26–27 are diagrams of one embodiment of a disassembled view of a microphone system, and a microphone opening system in the housing cover according to the invention.
Figure 27:
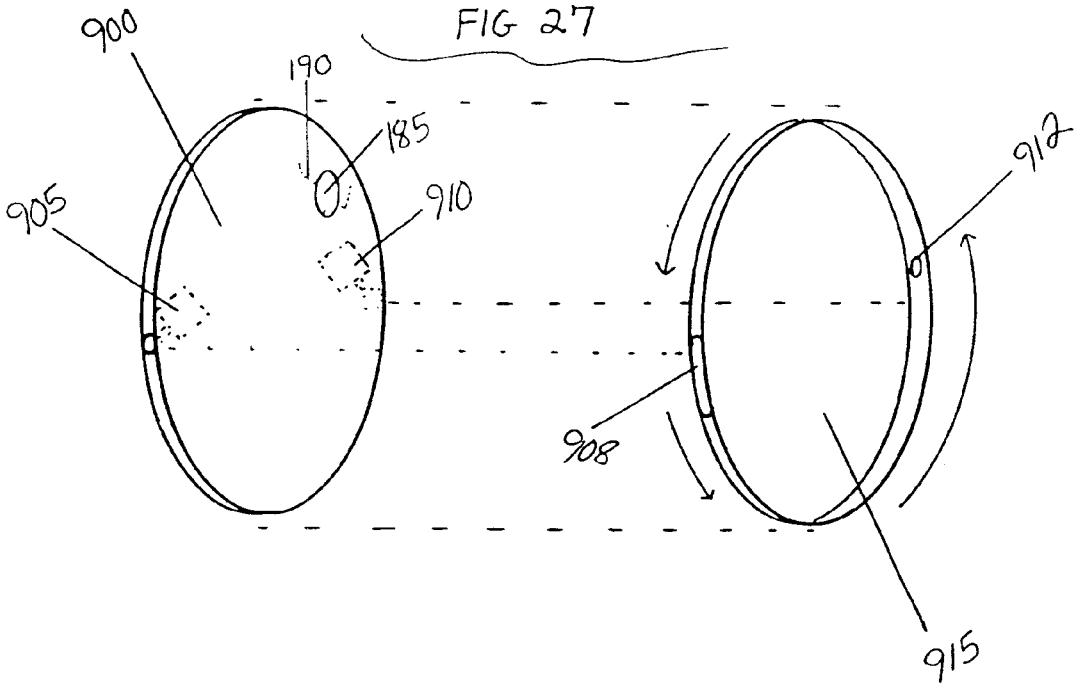

FIGS. 26–27 show one embodiment to the invention where housing 900 holds two microphones. Cover 915 has two apertures 908 and 912 which align with two microphones 905 and 910 (the microphones are shown by way of transparent views of housing 900). When cover 915 is completely tightened, then both microphones 905 and 910 receive sound pressure signals through two microphone openings 908 and 912. This duel system helps the wearer determine the source of the amplified signal. For example, microphone 905 might be disposed in the forward portion of housing 900 for detecting sound coming towards the face of the wearer. On the other hand, microphone 910 might be disposed in the rear of housing 900 for detecting sound coming towards the back of the wearer's head. The wearer will have the option as shown in FIG. 27 to slightly rotate cover 915 which will have the effect of shutting off the signal to one microphone while not interrupting the signal to the other microphone. This creates a single source of sound pressure signal originating from either in front of, or in back, of the wearer which can sometimes be desirable.

Figure 29:
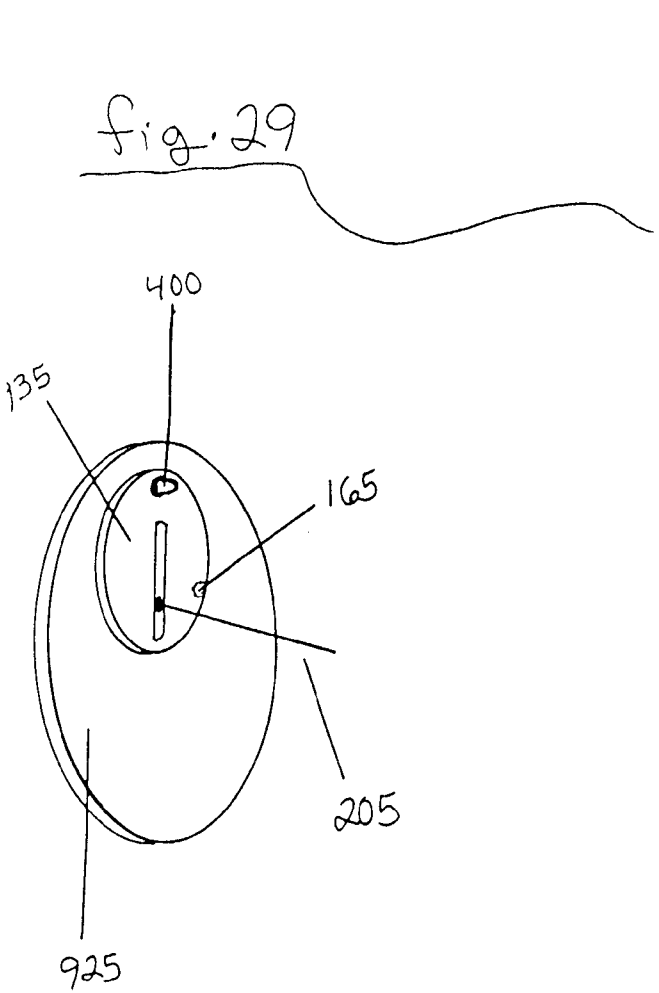
FIGS. 28–29 are diagrams of one embodiment of a dissembled view of an oversized cover and housing connection according to the invention.
Figure 28:
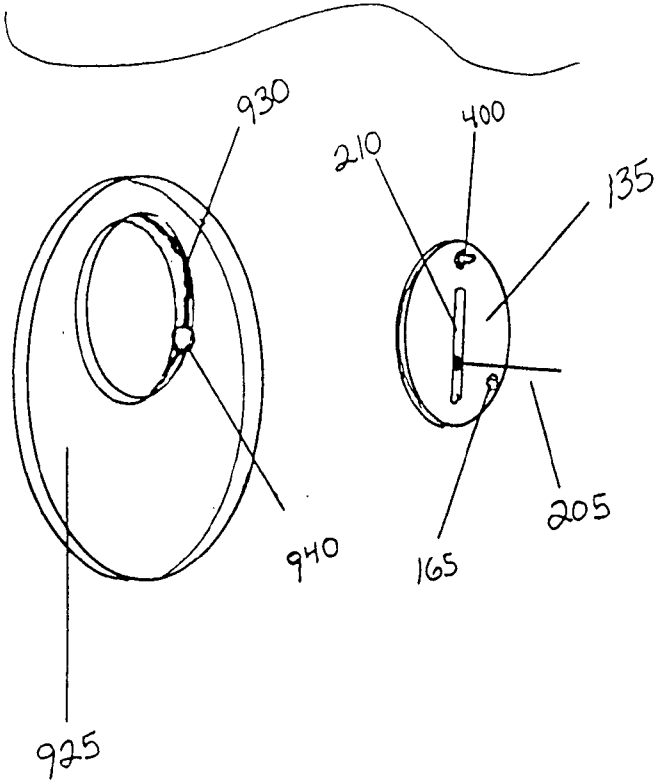

FIGS. 28–29 show an alternative oversized cover connection. In FIG. 28, cover 925 has an off center type design. Cover 925 screws onto housing 135 as described herein. The microphone opening 940 is provided to pick the sound pressure signal from the rear of the cover 925 and the cover is also able to employ a duel microphone system as described herein. Those skilled in the art will recognize that the purpose of the cover is to add aesthetic appeal to the apparatus. Thus, various shapes, sizes, offsets and decorative effects can be employed to achieve that purpose.

FIG. 29 shows a rear view of one embodiment of the assembled apparatus. The breakaway connector 400 remains at the top of housing 135 and aligns with the intertragic notch of the pinna of the wearer where it can connect to mold 100 or a CIC ball and chain system. The stud-pin 205 is able to align with the pierced earlobe hole of the wearer. As described herein, a non-pierced earlobe connection means is also available. The oversized portion of cover 925 is predominately directed downward to sit near the bottom of the earlobe or preferably below the earlobe.

What is claimed is:

1. A hearing aid comprising:

an ear canal sound conduit insertable into the auditory canal of the wearer's outer ear, the sound conduit having an outermost portion connected to an innermost portion by a middle portion, the innermost portion substantially filling the auditory canal proximate to the eardrum, the middle portion having a cross-sectional area that is substantially less than the cross-sectional area of the auditory canal, wherein once the sound conduit is inserted into the wearer's ear, the innermost portion is proximately located near the eardrum, the middle portion travels along the auditory canal of the ear, and the outermost portion is disposed at the intertragic notch of the outer ear, said ear canal sound conduit defining a hollow receiver tube;

a hearing aid circuit for generating a sound signal output;

a housing having a major facade, the facade having a first side, a second side and defining a first aperture, the hearing aid circuit being disposed in said housing; and a breakaway connector, said connector passing through said first aperture and connecting the output from the hearing aid circuit to the outermost portion of the ear canal sound conduit wherein said break away connector further comprises an extension tube, said extension tube disposed at a nipple end of the connector and said extension tube engaging the end of the hollow receiver tube at the outermost portion of the ear canal sound conduit at one end, and the opposite end operatively connected to the hearing aid circuit.

2. The hearing aid of claim 1, wherein the outermost portion of the ear canal sound conduit further comprises a female receptacle having an innermost portion where the hollow receiver tube is disposed, and an entrance portion having a receiving ridge that circumscribes the entrance portion, the receiving ridge providing a guide for the breakaway connector thereby facilitating full insertion of the breakaway connector into the female receptacle of the sound conduit so that the end of the extension tube of the breakaway connector will engage the hollow receiver tube.

3. The hearing aid of claim 2, wherein the breakaway connector is only partially inserted into the female receptacle of the sound conduit.

4. A hearing aid comprising:

an ear canal sound conduit insertable into the auditory canal of the wearer's outer ear, the sound conduit having an outermost portion connected to an innermost portion by a middle portion, the innermost portion substantially filling the auditory canal proximate to the eardrum, the middle portion having a cross-sectional area that is substantially less than the cross-sectional area of the auditory canal, wherein once the sound conduit is inserted into the wearer's ear, the innermost portion is proximately located near the eardrum, the middle portion travels along the auditory canal of the ear, and the outermost portion is disposed at the intertragic notch of the outer ear, said ear canal sound conduit defining a hollow receiver tube;

a hearing aid circuit for generating a sound signal output;

a housing having a major facade, the facade having a first side, a second side and defining a first aperture, the hearing aid circuit being disposed in said housing;

a breakaway connector, said connector passing through said first aperture and connecting the output from the hearing aid circuit to the outermost portion of the ear canal sound conduit, a stud-pin having a shaft end and a head end wherein the housing has a vertical slot configured to receive the shaft end of the stud-pin, and the stud-pin is selectively fixed by the wearer so that the shaft end of the stud-pin protrudes through the vertical slot at a desirable position and angle, and the head end of the stud-pin is held in position between the circuit holder and the first side of the facade of the housing, and a circuit holder that is coupled to the first side of the facade of the housing, the circuit holder adapted to hold the hearing aid circuit.

5. The hearing aid of claim 4, further comprising a stud-clasp, wherein once the wearer selectively fixes the desirable position and angle of the stud-pin, the shaft end of the stud-pin can be slid into the hole of the wearer's pierced earlobe, and the stud-clasp is slid onto the shaft of the stud-pin behind the earlobe thereby securing the apparatus to the wearer's ear lobe.

6. The hearing aid of claim 4, further comprising an adjustable clip-on fastener, wherein the adjustable clip-on fastener is attached to the shaft end of the stud-pin, and once the wearer selectively fixes the desirable position and angle of the stud-pin, the clip-on fastener can be slid onto the wearer's earlobe thereby securing the apparatus to the wearer's ear lobe.

7. The hearing aid of claim 4, further comprising a housing cover configured to engage the first side of the facade of the housing thereby covering the circuit holder from view, the housing cover having an aperture that is substantially aligned with the input of the hearing aid circuit such that the aperture in the housing cover provides a clear path for sound to be received by the input.

8. The hearing aid of claim 4, wherein the earring further comprises an interchangeable earring face plate, the face plate substantially mimicking the interchangeable housing cover in size and appearance, where the housing cover and the face plate comprise one set of a plurality of interchangeable aesthetically different sets, thereby allowing the wearer to change the appearance of the apparatus and its accompanying earring on a regular basis.

9. The hearing aid of claim 8, wherein the interchangeable housing cover has an aperture that is substantially aligned with the input of the hearing aid circuit such that the aperture in the housing cover provides a clear path for sound to be received by the input.

10. The hearing aid of claim 9, wherein at least one set of the plurality of interchangeable aesthetically different set further comprises a housing cover and face plate that are substantially larger than the housing and the earring respectively.

11. A hearing aid comprising:

an ear canal sound conduit insertable into the auditory canal of the wearer's outer ear, the sound conduit having an outermost portion connected to an innermost portion by a middle portion, the innermost portion substantially filling the auditory canal proximate to the eardrum, the middle portion having a cross-sectional area that is substantially less than the cross-sectional area of the auditory canal, wherein once the sound conduit is inserted into the wearer's ear, the innermost portion is proximately located near the eardrum, the middle portion travels along the auditory canal of the ear, and the outermost portion is disposed at the intertragic notch of the outer ear, said ear canal sound conduit defining a hollow receiver tube;

a hearing aid circuit for generating a sound signal output;

a housing having a major facade, the facade having a first side, a second side and defining a first aperture, the hearing aid circuit being disposed in said housing;

a breakaway connector, said connector passing through said first aperture and connecting the output from the hearing aid circuit to the outermost portion of the ear canal sound conduit, and a stud-pin having a shaft end and a head end wherein the housing has a vertical slot configured to receive the shaft end of the stud-pin, and the stud-pin is selectively fixed by the wearer so that the shaft end of the stud-pin protrudes through the vertical slot at a desirable position and angle, and the head end of the stud-pin is held in position between the interchangeable housing cover and the first side of the facade of the housing.

12. The hearing aid of claim 11, wherein the apparatus is accompanied by an earring that is substantially similar in appearance to the appearance of the apparatus thereby allowing the wearer to wear the apparatus in one ear while wearing the earring in the other ear so as to give the appearance that the wearer is merely wearing a pair of earrings rather than a hearing aid.

13. A hearing aid apparatus comprising:

a first microphone for generating a signal;

an amplifier configured to receive the signal generated by the first microphone for producing the amplified signal; a control means adapted to control the amplifier;

a control means adapted to control the amplifier;

an ear canal sound conduit insertable into the auditory canal of the wearer's outer ear, the sound conduit portion having an outermost portion connected to an innermost portion by a middle portion, the innermost portion substantially filling the auditory canal proximate to the eardrum, and the middle portion having a cross-sectional area that is substantially less than the cross-sectional area of the auditory canal, wherein once the sound conduit is inserted into the wearer's ear, the innermost portion is proximately located near the eardrum, the middle portion travels along the auditory canal of the ear, and the outermost portion is disposed at the intertragic notch of the outer ear, said ear canal conduit defining a hollow receiver tube;

a housing having a major facade, the facade having a first side, a second side, and defining an aperture, the housing adapted to hold at least a partial hearing aid circuit including the first microphone, the amplifier, the control means, and a battery;

a breakaway connector having a nipple end and a connective end, the connective end having an entrance hole with a perimeter, the connective end being connected to the housing so that the perimeter of the entrance hole is disposed substantially over the aperture on the second side of the facade of the housing, an output of the partial hearing aid circuit being coupled to the entrance hole of the connective end of the breakaway connector, and the nipple end of the breakaway connector having an outer surface that abuttingly engages an opening at the outermost portion of the sound conduit;

a receiver disposed in the innermost portion of the sound conduit proximate the eardrum, the receiver configured to convert the amplified signal into a sound pressure signal;

an electronic coupling means that provides a transmission path between the amplifier and the receiver so that the amplified signal can be received by the receiver;

wherein the amplified signal received by the receiver is converted into the sound pressure signal, the sound pressure signal being substantially delivered to the eardrum.

14. The apparatus of claim 13, wherein the electronic coupling means has a breakaway connection at a point where the nipple end of the breakaway connector is configured to engage the outermost portion of the sound conduit.

15. The apparatus of claim 14, further comprising a second microphone for generating a second signal, wherein the first microphone is disposed in a forward portion of the housing and the second microphone is disposed in a rear portion of the housing.

16. The apparatus of claim 15, further comprising a housing cover configured to engage the housing thereby covering the at least partial hearing aid circuit from view, the housing cover having a first aperture that is aligned with the first microphone and a second aperture that is substantially aligned with the second microphone such that the first and second apertures in the housing cover provide a clear path for sound to be received by the first and second microphones respectively.

17. The apparatus of claim 16, wherein the housing cover can be rotatably engaged by the apparatus wearer so that at least one of the first and second microphones is misaligned with at least one of the first and second apertures respectively, thereby removing a clear path for sound to be received by at least one of the first and second microphones.

18. The hearing aid apparatus of claim 13, said circuit holder comprising an interface module adapter with a plurality of terminals, adapted to operatively connect with a digitally programmable hearing instrument programming system.

19. The hearing aid apparatus of claim 13, said circuit holder comprising a flat battery holder having a plurality of terminals, said terminals adapted to operatively connect with a digitally programmable hearing instrument system.

20. The hearing aid apparatus of claim 13, said circuit holder comprising an interface module adapter with a plurality of terminals, adapted to operatively connect with a digitally programmable hearing instrument programming system.

21. The hearing aid apparatus of claim 13, said circuit holder comprising a flat battery holder having a plurality of terminals, said terminals adapted to operatively connect with a digitally programmable hearing instrument system.

22. A hearing aid according to claim 13 further comprising, a decorative cover system including a housing and insertable removable magnetized decorative elements, where the appearance of said earing can be altered by magnetically attaching one or more different magnetic decorations to said housing.

23. A hearing aid comprising:

an ear canal sound conduit insertable into the auditory canal of the wearer's outer ear, the sound conduit having an outermost portion connected to an innermost portion by a middle portion, the innermost portion substantially filling the auditory canal proximate to the eardrum, the middle portion having a cross-sectional area that is substantially less than the cross-sectional area of the auditory canal, wherein once the sound conduit is inserted into the wearer's ear, the innermost portion is proximately located near the eardrum, the middle portion travels along the auditory canal of the ear, and the outermost portion is disposed at the intertragic notch of the outer ear, said ear canal sound conduit defining a hollow receiver tube;

a hearing aid circuit for generating a sound signal output;

a housing having a major facade, the facade having a first side, a second side and defining a first aperture, the hearing aid circuit being disposed in said housing; and a breakaway connector, said connector passing through said first aperture and connecting the output from the hearing aid circuit to the outermost portion of the ear canal sound conduit, a circuit holder that is coupled to the first side of the facade of the housing, the circuit holder adapted to hold the hearing aid circuit, and a stud-pin having a shaft end and a head end wherein the housing has a vertical slot configured to receive the shaft end of the stud- pin, and the stud-pin is selectively fixed by the wearer so that the shaft end of the stud-pin protrudes through the vertical slot at a desirable position and angle.

24. The hearing aid of claim 23, further comprising a stud-clasp, wherein once the wearer selectively fixes the desirable position and angle of the stud-pin, the shaft end of the stud-pin can be slid into the hole of the wearer's pierced earlobe, and the stud-clasp is slid onto the shaft of the stud-pin behind the earlobe thereby securing the apparatus to the wearer's ear lobe.

25. The hearing aid of claim 23, further comprising an adjustable clip-on fastener, wherein the adjustable clip-on fastener is attached to the shaft end of the stud-pin, and once the wearer selectively fixes the desirable position and angle of the stud-pin, the clip-on fastener can be slid onto the wearer's earlobe thereby securing the apparatus to the wearer's ear lobe.

* * * * *